US007955186B2

(12) United States Patent
Sato et al.

(10) Patent No.: US 7,955,186 B2
(45) **Date of Patent: *Jun. 7, 2011**

(54) GOLF CLUB AND SHAFT REPLACING METHOD

(75) Inventors: Fumiaki Sato, Chichibu (JP); Hiroshi Takahashi, Chichibu (JP); Hideo Matsunaga, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 151 days.

This patent is subject to a terminal disclaimer.

(21) Appl. No.: 12/338,533

(22) Filed: Dec. 18, 2008

(65) Prior Publication Data

US 2010/0056292 A1 Mar. 4, 2010

(30) Foreign Application Priority Data

Sep. 1, 2008 (JP) ..... 2008-223644

(51) Int. Cl.
*A63B 53/02* (2006.01)

(52) U.S. Cl. ..... 473/307; 473/310

(58) Field of Classification Search ..... 473/288, 473/296, 298–299, 307, 310
See application file for complete search history.

(56) References Cited

U.S. PATENT DOCUMENTS

| | | | | |
|---|---|---|---|---|
| 2,219,670 | A | 10/1940 | Wettlaufer | |
| 3,524,646 | A | 8/1970 | Wheeler | |
| 3,891,212 | A | 6/1975 | Hill | |
| 5,851,155 | A | 12/1998 | Wood et al. | |
| 5,906,549 | A | 5/1999 | Kubica | |
| 6,620,054 | B2 * | 9/2003 | Tseng | 473/306 |
| 6,890,269 | B2 | 5/2005 | Burrows | |
| 7,083,529 | B2 * | 8/2006 | Cackett et al. | 473/309 |
| 7,704,158 | B2 * | 4/2010 | Burrows | 473/288 |
| 2002/0037773 | A1 | 3/2002 | Wood et al. | |
| 2003/0228929 | A1 * | 12/2003 | Miyasu et al. | 473/300 |
| 2004/0018887 | A1 * | 1/2004 | Burrows | 473/307 |
| 2007/0173344 | A1 * | 7/2007 | Burch | 473/305 |

FOREIGN PATENT DOCUMENTS

| | | | |
|---|---|---|---|
| FR | 2626187 | A1 | 7/1989 |
| FR | 2654354 | A1 | 5/1991 |
| GB | 2207358 | A | 2/1989 |
| JP | 64-39766 | | 3/1989 |
| JP | 1-91875 | A | 4/1989 |
| JP | 2-49673 | A | 2/1990 |
| JP | 3-176084 | A | 7/1991 |
| JP | 4-156869 | A | 5/1992 |
| JP | 4-286787 | A | 10/1992 |
| JP | 7-231960 | A | 9/1995 |
| JP | 8-336622 | A | 12/1996 |
| JP | 9-75482 | A | 3/1997 |
| JP | 9-164227 | A | 6/1997 |
| JP | 10-151228 | A | 6/1998 |
| JP | 11-178954 | A | 7/1999 |
| JP | 2000-157650 | A | 6/2000 |
| JP | 2003-070940 | A | 3/2003 |
| JP | 2003-093551 | A | 4/2003 |

* cited by examiner

*Primary Examiner* — Stephen L. Blau
(74) *Attorney, Agent, or Firm* — Sughrue Mion, PLLC

(57) ABSTRACT

According to an aspect of the invention, a golf club includes: a head having a hosel; a shaft; a shaft case fixed to one end of the shaft, and configured to be inserted into the hosel, the shaft case being formed in a substantially cylindrical shape; and a ring-shaped screw member configured to be screwed into one end of the hosel to fix the shaft case in the hosel, and to be fitted with an outer face of an one end of the shaft case, the ring-shaped screw member being noncontact with the shaft.

12 Claims, 20 Drawing Sheets

GOLF CLUB AND SHAFT REPLACING METHOD

CROSS-REFERENCE TO RELATED APPLICATIONS

This application is based upon and claims the benefit of priority from Japanese Patent Application No. 2008-223644, filed Sep. 1, 2008, the entire contents of which are incorporated herein by reference.

BACKGROUND

1. Field

The present invention relates to a golf club and, specifically, it relates to a golf club which is capable of replacing a shaft easily. Also, the invention relates to a method for replacing the shaft of the golf club.

2. Description of the Related Art

A golf club includes a shaft and a head mounted on the leading end portion of the shaft. A grip is mounted on the base end portion of the shaft.

In a conventional ordinary golf club head, a hosel hole is formed directly in the head, and a shaft is inserted into the hosel hole and is fixed to the golf club head using an adhesive. Here, as the adhesive, there is generally used an epoxy-system adhesive. For replacement of the shaft, the hosel hole portion of the golf club head may be heated to destroy the structure of the hosel hole portion made of hardened epoxy resin, whereby the shaft can be pulled out.

In JP-A-11-178954, there is disclosed a golf club head structured such that a head main body and a hosel are provided separately from each other and the hosel is fixed to the head main body using a screw. According to the structure of the golf club head disclosed in the Japanese Patent Publication Hei-11-178954, a plate-shaped neck portion is formed on the lower end side of the hosel, while the neck portion is inserted into the insertion portion of the head main body and is then fixed to the head main body using a screw. By fixing the plate-shaped neck portion to the head main body in this manner, when hitting a golf ball with the golf club, that is, at the impact time, the neck portion is caused to bend to thereby relieve the concentration of stresses that are generated in the connecting portion between the shaft and hosel.

In the golf club head disclosed in JP-A-11-178954, the connecting strength and rigidity of the head main body and hosel are short, thereby being unable to provide a strong feeling of impact. Also, the position of the hosel is excessively high.

SUMMARY OF THE INVENTION

A golf club according to the invention is a golf club having a head mounted on the leading end of a shaft, in which a substantially cylindrical-shaped shaft case is fixed to the leading end of the shaft, the shaft case is inserted into a hosel formed in the head from the upper end side of the hosel, the shaft case is fixed to the hosel by a ring-shaped screw member fitted with the outer surface of the shaft case as well as removably and threadedly engaged with the upper end side of the hosel, and the screw member is disposed on the outer periphery of the shaft case in such a manner that it is not in contact with the shaft.

A golf club according to the invention is a golf club according to one embodiment, in which the shaft case includes a projecting portion on the outer peripheral surface of the middle portion thereof existing in the axial direction of the cylindrical shape thereof, the head includes a head main body and the hosel fixed to the head main body., a female screw is cut formed on the inner peripheral surface of the upper end side of the hosel, a male screw is cut formed on the outer peripheral surface of the screw member, the male screw is threadedly engaged with the female screw of the hosel to thereby threadedly engage the screw member with the hosel, and the lower end face of the screw member is pressed against the projecting portion downwardly to thereby fix the shaft case to the shaft.

A golf club according to the invention is a golf club according one embodiment, in which the shaft case includes a small diameter portion on the outer peripheral surface of the middle portion thereof existing in the axial direction of the cylindrical shape thereof, the lower portion of the shaft case than the small diameter portion is formed as a large diameter portion, a lower-side step surface is interposed between the small and large diameter portions, the upper portion of the shaft case than the small diameter portion is formed as an enlarged-diameter portion, an upper-side step surface is interposed between the small diameter portion and enlarged-diameter portion, the head includes a head main body and the hosel fixed to the head main body, a female screw is cut formed on the inner peripheral surface of the upper end side of the hosel, a male screw is cut formed on the outer peripheral surface of the screw member, the male screw is threadedly engaged with the female screw of the hosel to thereby threadedly engage the screw member with the hosel, the lower end face of the screw member is pressed against the lower-side step surface downwardly to thereby fix the shaft case to the shaft, and the upper end face of the screw member is pressed against the upper-side step surface to thereby be able to prevent the shaft case from being removed from the hosel.

A golf club according to the invention is a golf club according to one embodiment, in which an elastic member is provided on the lower side of the screw member.

A golf club according to the invention is a golf club according to any one of embodiments, in which the shaft case is made of a cylindrical member having its lower end side closed with its upper end side opened, and the shaft is inserted into the shaft case and is fixed thereto using an adhesive.

A golf club according to the invention is a golf club according to one embodiment, in which at least the lower end side of the shaft case is formed as a non-circular section shape portion and, at least on the lower end side of the hosel, there is formed a non-circular section shape portion with which the leading end side of the shaft case is engaged.

A golf club according to the invention is a golf club according to one embodiment, in which the non-circular section shape portion of the shaft case is formed of an inclined surface obliquely intersecting with the center axis of the shaft case, and the non-circular section shape portion of the hosel is formed of an inclined surface obliquely intersecting with the center axis of the hosel.

A golf club according to the invention is a golf club according to any one of embodiments, in which an elastic member is interposed between the lower end side of the shaft case and the inner surface of the hosel.

A golf club according to the invention is a golf club according to any one of embodiments, a grip is mounted on the shaft, and the grip includes a projecting portion extending in the longitudinal direction of the shaft.

A method according to the invention is a method for replacing the shaft of a golf club as set forth in any one of embodiments with a new shaft, comprising the steps of: previously fixing a new shaft to a shaft case of the same type as the shaft case to form a new shaft case/shaft connected assembly; and, removing an old shaft case/shaft connected assembly currently mounted on the golf club from the head of the golf club and then mounting the new shaft case/shaft connected assembly onto the golf club head.

In a golf club and a shaft replacing method according to the invention, when the screw member is loosened and removed, the shaft case can be pulled out from the hosel. Specifically, a new shaft case/shaft connected assembly, in which a new shaft has been previously mounted on a shaft case, may be inserted into the hosel, and the screw member may be then threadedly mounted onto the assembly, whereby the currently used or old shaft can be replaced with the new shaft.

According to the invention, since the shaft case is inserted into the cylindrical-shaped hosel and is fixed to the hosel using the screw member, the mounting of the shaft case on the hosel can be made firm.

According to the invention, since the screw member is disposed on the outer periphery of the shaft case but is not in contact with the shaft, even when the screw member is rotated, the screw member will never rub against the shaft, thereby being able to prevent the shaft against damage.

Conventionally, after the adhesive is heated to thereby destroy the structure thereof, a currently used shaft is removed and a new shaft is then mounted using the adhesive again. This takes troublesome labor and time. On the other hand, the invention can save such troublesome labor and time. Owing to this, just after the shaft is removed from the head of the golf club used for a ball hitting test, another shaft of different characteristics can be mounted onto the head of the golf club for another hitting test. This makes it possible to a golfer to find out a proper golf club in a golf shop very easily.

According to a golf club in the invention, when the screw member is screwed into the upper end side of the hosel, the lower end of the screw member is pressed against the projecting portion of the shaft case (in a golf club according to an embodiment) or the lower-side step surface of the shaft case (in a golf club according to an embodiment), whereby the shaft case can be fixed. In a golf club according to an embodiment, when the screw member is rotated reversely, the screw member is pressed against the upper-side step surface of the shaft case upwardly, whereby the shaft case can be removed from the hosel.

According to a golf club in the invention, generation of rickety motion between the screw member and the projecting portion of the shaft case can be prevented.

According to a golf club in the invention, the shaft can be inserted into the deep portion of the shaft case and can be thereby adhered to the shaft case firmly.

According to a golf club in the invention, the peripheral direction positioning of the shaft case can be carried out. Also, the head and shaft case can be prevented against rotation with respect to each other. Here, preferably, there may be formed non-circular section shape portions in the shaft case and hosel respectively. In this case, when the grip includes a projecting portion, the projecting portion can be positioned accurately in the surface that, when a golfer holds the golf club for addressing a golf ball, faces the ground.

According to a golf club in the invention, the shaft case can be easily inserted into the hosel.

According to a golf club in the invention, shocks and vibrations generated between the shaft case and the inner surface of the hosel can be absorbed.

DETAILED DESCRIPTION

Figure 1:
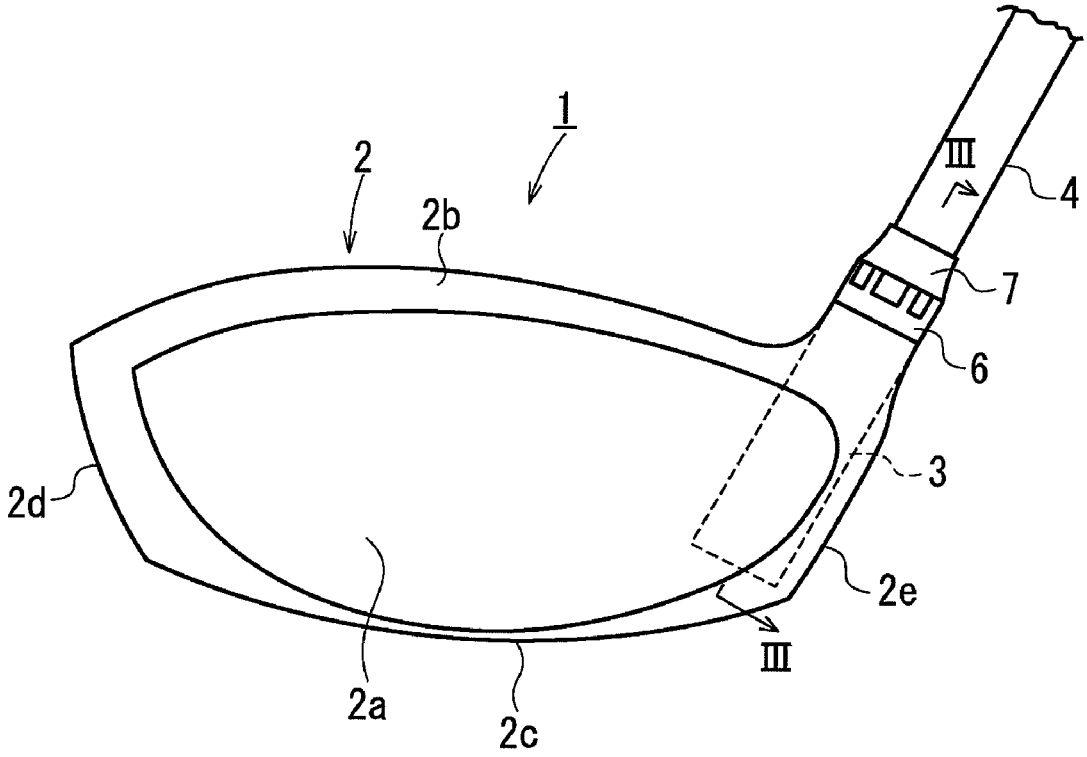
FIG. 1 is an exemplary front view of a head according to a first embodiment of the invention.
Figure 2:
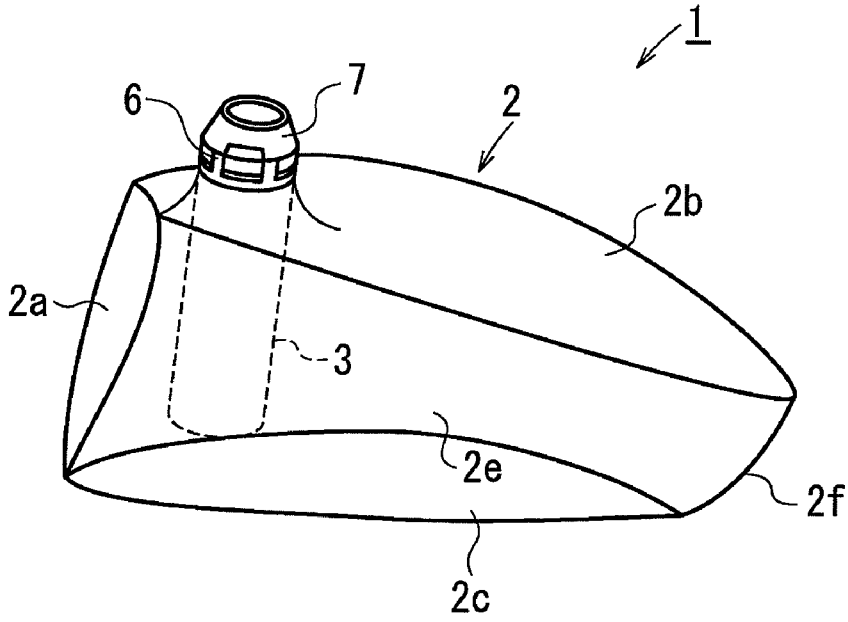
FIG. 2 is an exemplary side view of the heel side of the head.
Figure 3:
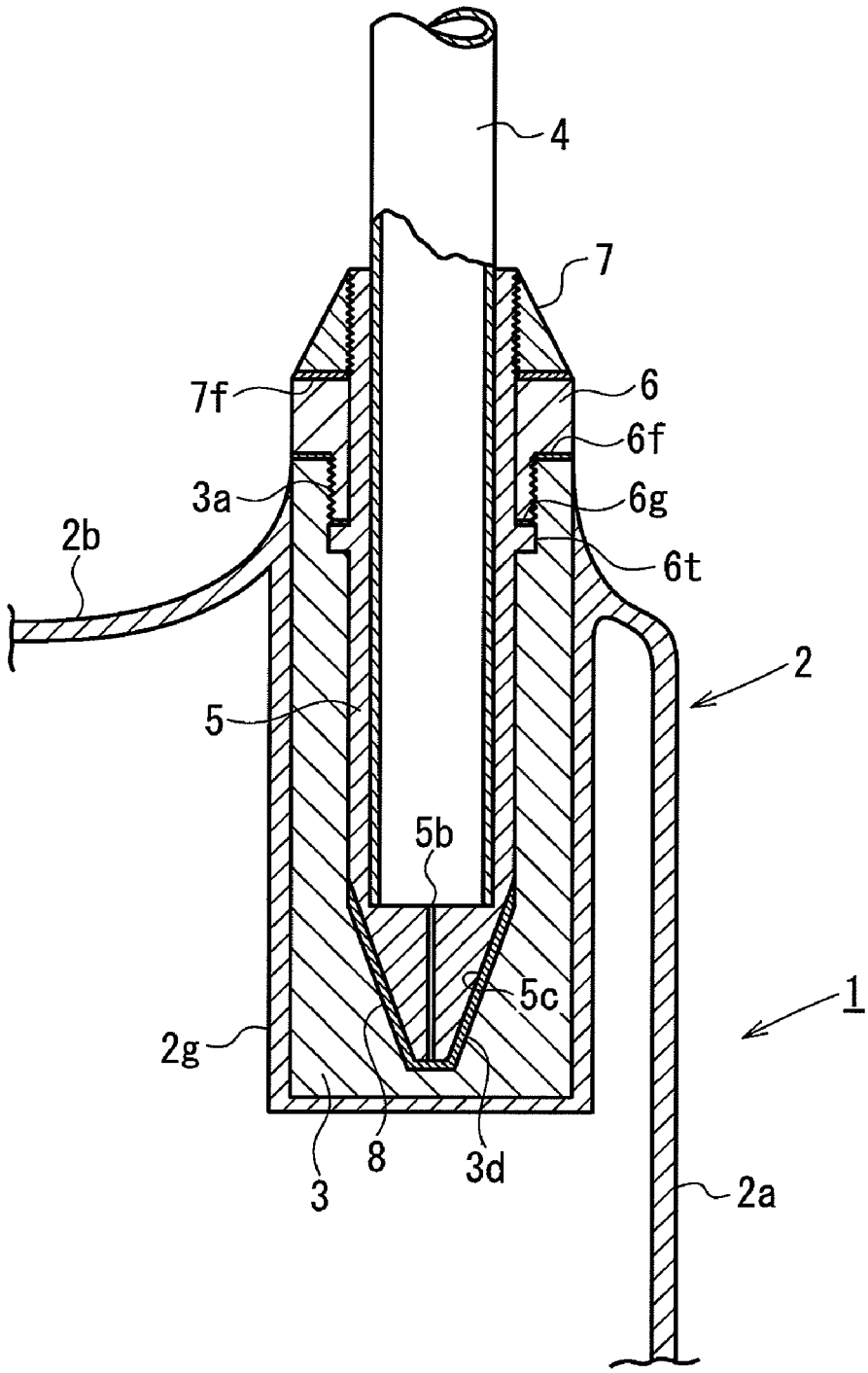
FIG. 3 is an exemplary section view taken along the III-III line shown in FIG. 1.
Figure 4:
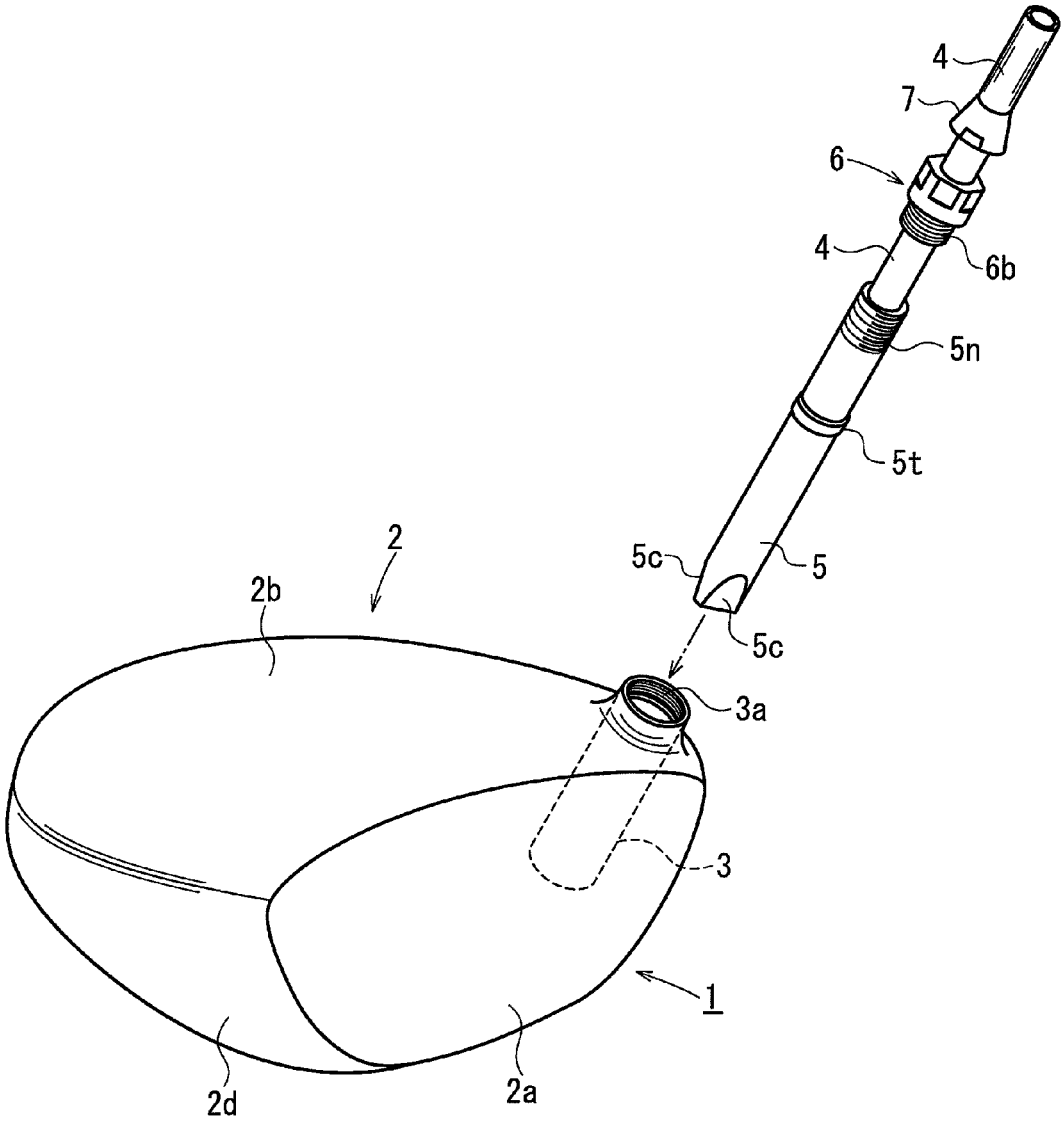
FIG. 4 is an exemplary perspective view of the head, showing how to mount and replace a shaft.
Figure 5:
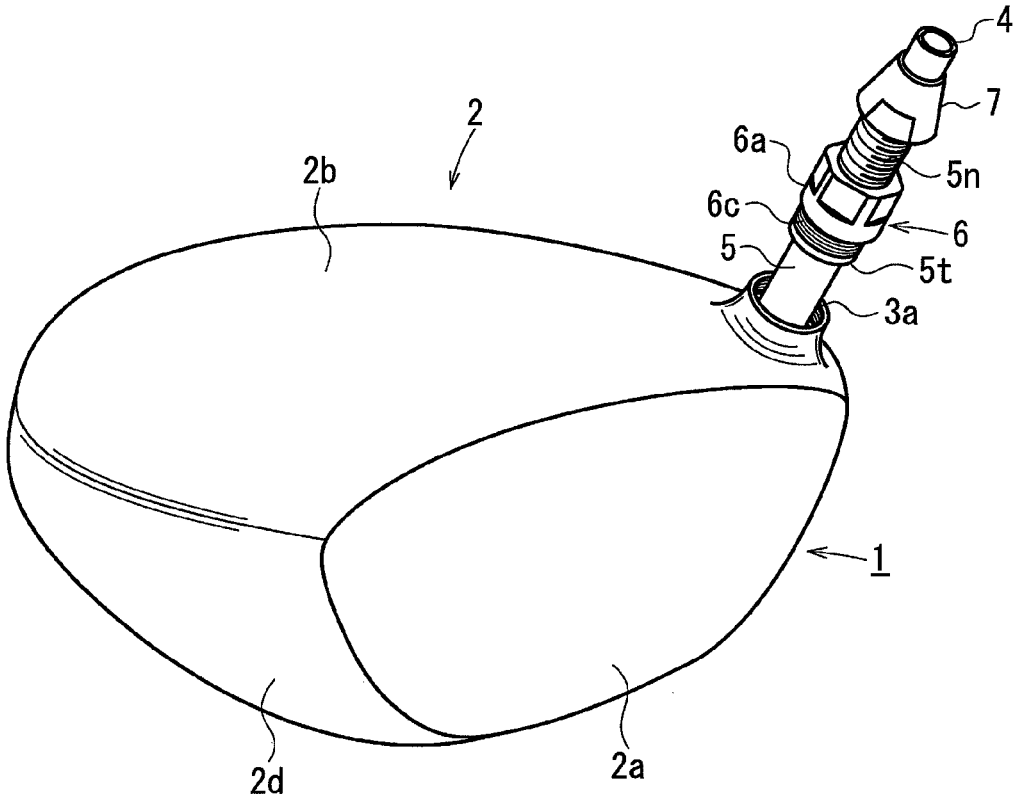
FIGS. 5A and 5B are exemplary perspective views of the head, showing how to mount and replace the shaft of the head.
Figure 5:
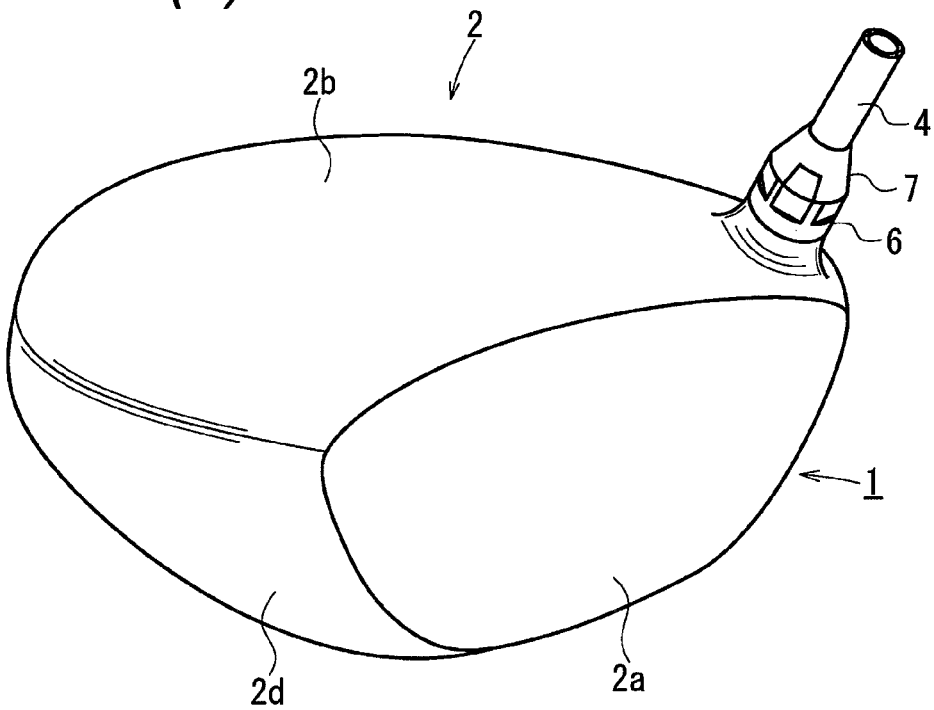
Figure 6:
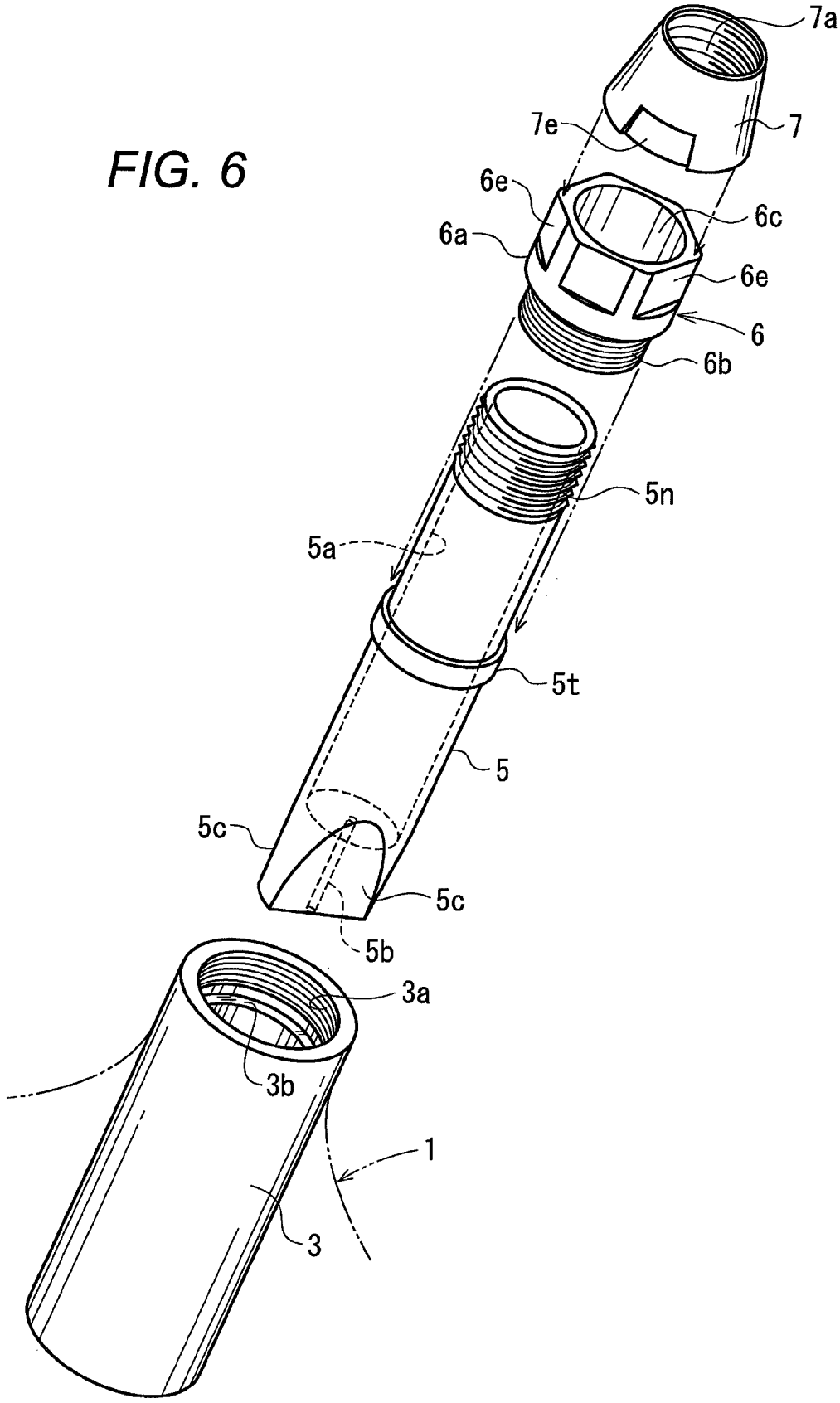
FIG. 6 is an exemplary perspective view of a hosel, a shaft case and a screw member used in the first embodiment.
Figure 7:
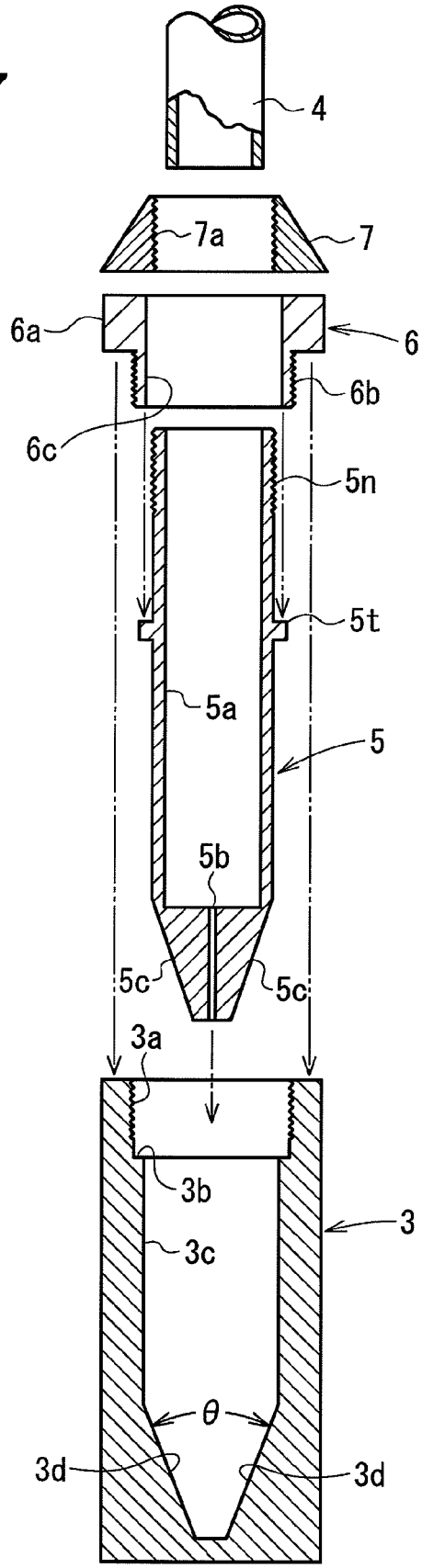
FIG. 7 is an exemplary section view of the above-mentioned hosel, shaft case and screw member.
Figure 8:
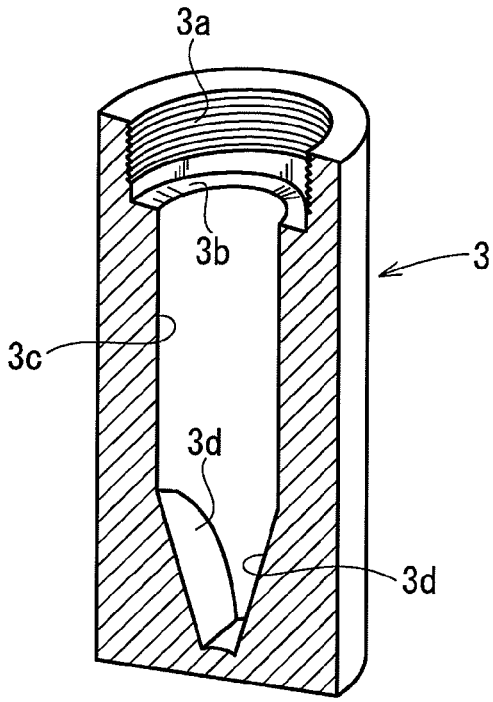
FIG. 8 is an exemplary perspective section view of the hosel.

Now, description will be given below of embodiments according to the invention with reference to the accompanying drawings. Specifically, FIG. 1 is a front view of a golf club head according to a first embodiment of the invention. FIG. 2 is a side view of the heel side of the golf club head. FIG. 3 is a section view taken along the III-III line shown in FIG. 1. FIGS. 4 and 5(A), 5B are respectively perspective views of the golf club head, showing how to mount and replace the shaft of the golf club head. FIG. 6 is a perspective of a hosel, a shaft case, a screw member and a top portion. FIG. 7 is a section view of the hosel, shaft case, screw member and top portion. FIG. 8 is a sectional perspective view of the hosel.

In this golf club, a shaft 4 is mounted on the hosel 3 of a head 1 through a shaft case 5 and a screw member 6.

The head 1 includes a head main body 2 and a hosel 3 mounted on -the head main body 2. This head 1, which is of a hollow wood type, includes a face portion 2*a*, a crown portion 2*b*, a sole portion 2*c*, a toe portion 2*d*, a heel portion 2*e* and a back portion 2*f*.

Figure 18:
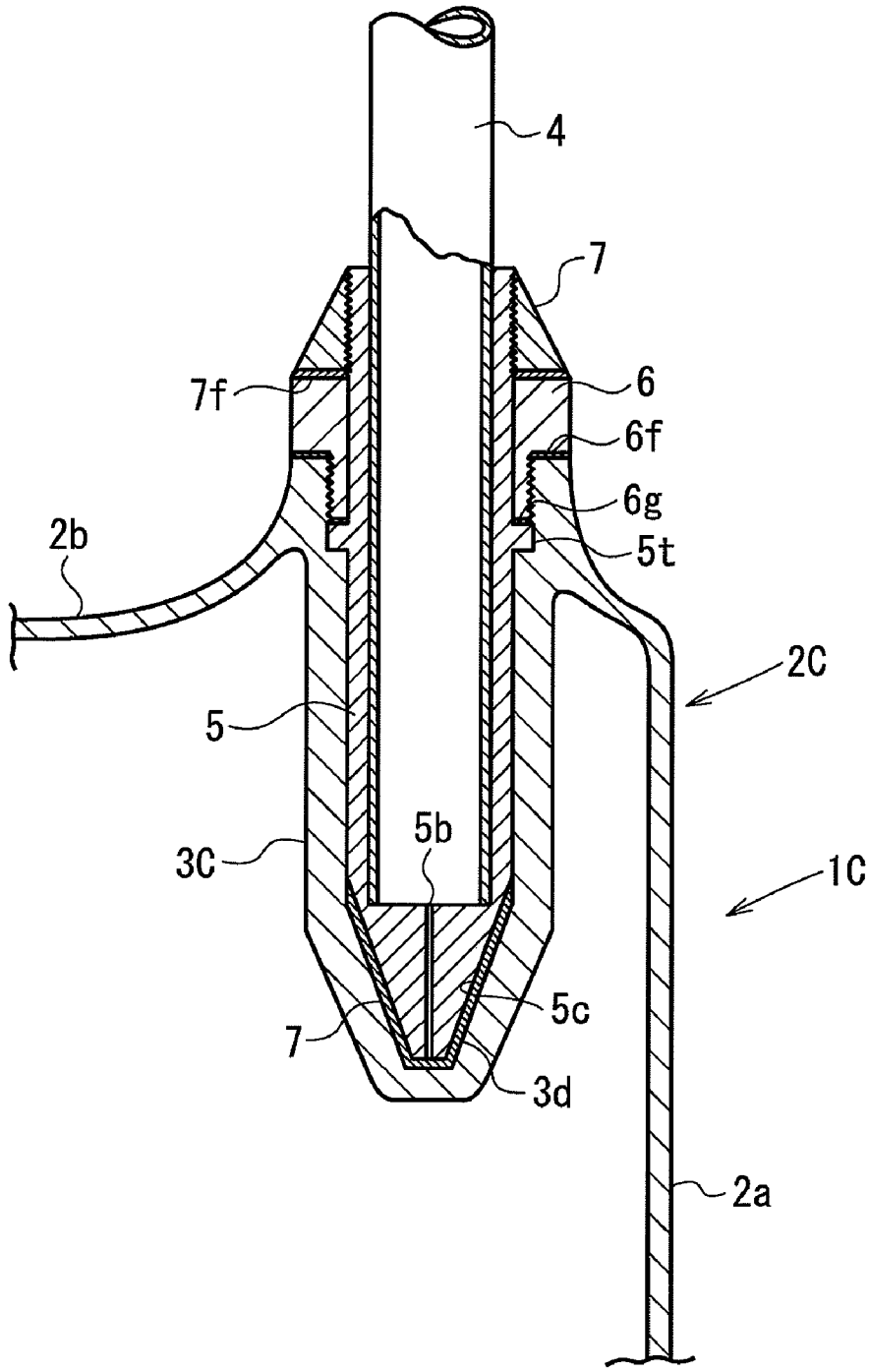
FIG. 18 is an exemplary section view of a head according to a fifth embodiment of the invention.

As shown in FIG. 3, in the face portion 2a side and heel portion 2*e* side of the crown portion 2*b*, there is formed a cylindrical-shaped hosel installation portion 2*g*. The hosel installation portion 2*g* has a cylindrical shape the upper end of which is open and the lower end of which is closed, and also the hosel installation portion 2*g* extends coaxially with the shaft 4. The hosel 3 is inserted into the hosel installation portion 2*g* from above and is fixed by proper fixing means such as by welding, by brazing, by adhesion, by shrinkage fit, or by expansion fit. However, alternatively, as shown in FIG. 18 which will be discussed later, the hosel may also be formed integrally with the head main body. For example, the hosel may be formed integrally with the head main body by casting and, in order to enhance the dimension precision thereof, it may be then worked using a CNC working machine.

As shown in FIGS. 6 to 8, the hosel 3 has a substantially cylindrical shape in which there is opened up a hole extending in the axial direction thereof from the upper end thereof toward the lower end thereof.

In the entrance side of the hole, that is, in the inner peripheral surface of the upper end side of the hosel, there is formed a female screw 3*a*. In this embodiment, this female screw 3*a* is a reverse screw, while a male screw 6*b* formed in a screw member 6 (which will be discussed later) and threadedly engageable with the female screw 3*a* is also a reverse screw.

Continuously with the female screw 3*a*, specifically, in the diameter-reducing direction of the hosel 3, there is formed a step surface 3*b;* and, the deeper side of the hosel 3 than the step surface 3*b* is formed as a cylindrical portion 3*c*. In the deeper side of the hosel 3 than the cylindrical portion 3*c*, there are formed a pair of inclined surfaces 3*d* and 3*d* which respectively intersect obliquely with the axis of the hosel 3. The inclined surfaces 3*d*, 3*d* are arranged symmetrically with the axis of the hosel 3 between them. The distance between the two inclined surfaces 3*d*, 3*d*, that is, the spacing thereof in the direction perpendicular to the hosel axial line decreases as it goes toward the lower end side of the hosel 3. The angle of intersection θ (FIG. 7) between the inclined surfaces 3*d*, 3*d*, preferably, may be set for 10 to 30°, more preferably, for 15 to 20°.

As shown in FIGS. 6 and 7, the shaft case 5 is a cylindrical member having a diameter slightly smaller than the diameter of the cylindrical portion 3*c* of the hosel 3; and the shaft case 5 has a hole 5*a* which extends from the upper end side thereof toward the lower end side thereof and also into which the shaft 4 can be inserted. The length of the shaft case 5 may preferably be 30 mm or more, for example, 40 to 60 mm, more preferably, about in the range of 45 to 55 mm. In a state where the shaft case 5 is inserted into and fixed to the hosel 3, the shaft case 5 may preferably project from the hosel 3 by 10 to 30 mm, more preferably, by 15 to 20 mm.

In the shaft case 5, there is opened up a small hole 5*b* serving as an air bleeder which extends from the deep bottom surface of the hole 5*a* to the lower end face of the shaft case 5. Here, the cylindrical portion of the hole 5*a* of the shaft case 5, preferably, may extend up to (deeper than) a position where the inclined surfaces 3*d* are formed. In the present golf club, when hitting the ball, the inclined surfaces receive the hitting impact. Therefore, the present golf club can provide a similar hitting feeling to an ordinary golf club in which a head and a shaft are fixed together using an adhesive.

The shaft case 5 includes a projecting portion 5*t* formed on the outer peripheral surface of the middle portion of the cylindrical shape of the shaft case 5 in the axial direction (longitudinal direction) thereof. In the present embodiment, the projecting portion 5*t* is formed as a flange-shaped portion which is wound around the shaft case 5. The projecting portion 5*t* has a diameter which allows the projecting portion 5*t* to be contacted with the step portion 3*b* from above.

The shaft case 5 includes a male screw 5*n* formed on the outer peripheral surface of the upper portion thereof.

The depth of the cylindrical portion of the hole 5*a* for connection with the shaft may preferably be in the range of 20 mm to 50 mm, more preferably, in the range of 25 mm to 40 mm.

The distance from the upper end of the shaft case 5 to the projecting portion 5*t* may preferably be about in the range of 10 mm to 30 mm, more preferably, in the range of 15 mm to 20 mm.

On the outer surface of the lower end side of the shaft case 5, there are provided a pair of inclined surfaces 5*c* and 5*c*. These inclined surfaces 5*c* and 5*c* are arranged symmetrically with the axial line of the shaft case 5 between them. The distance between the inclined surfaces 5*c* and 5*c*, that is, the spacing thereof in the direction perpendicular to the axial line of the shaft case 5 decreases as it goes toward the lower end side of the shaft case 5. The angle of intersection θbetween the inclined surfaces 5*c* and 5*c* is the same as the angle of intersection θbetween the inclined surfaces 3*d* and 3*d* of the hosel 3. The size of the inclined surface 5*c* of the shaft case 5 may be the same as the inclined surface 3*d* of the hosel 3, or, when an elastic member is interposed between the inclined surfaces 5*c*, the size of the inclined surface 5*c* may be slightly smaller than that of the inclined surface 3*d*.

Although not shown, the inner peripheral edge of the upper end side of the shaft case 5 may be chamfered about at an angle of 20 to 45° to thereby facilitate the insertion of the shaft 4.

The screw member 6 has a substantially ring-like shape; the lower half section of the screw member 6 is smaller in diameter than the upper half section thereof; and, on the outer peripheral surface of the lower half section of the screw member 6, there is formed a male screw 6*b*. The outer peripheral surface of the upper end side of the upper half section 6*a* includes six plane portions 6*e* and provides a nut-like shape.

The lower half section of the screw member 6 has a diameter which allows the male screw 6*b* to be threadedly engaged with the female screw 3*a* of the hosel 3. The screw member 6 includes a hole 6*c* which penetrates therethrough in the axial direction thereof. The diameter of this hole 6*c* is set slightly larger than the diameter of the upper portion of the shaft case 5 than the projecting portion 5*t* thereof, while the screw member 6 is slidably fitted with the outer surface of the upper portion of the shaft case 5 than the projecting portion 5*t* thereof.

Between the lower end face of the upper half section 6a of the screw member 6 and the upper end face of the hosel 3 as well as between the lower end face of the lower half section 6*b* and the upper surface of the projecting portion 5*t*, as shown in FIG. 3, there are interposed ring-shaped spacers (for example, spacers respectively composed of an elastic member which is made of rubber, an elastomer or the like) 6*f* and 6*g* respectively.

Figure 21:
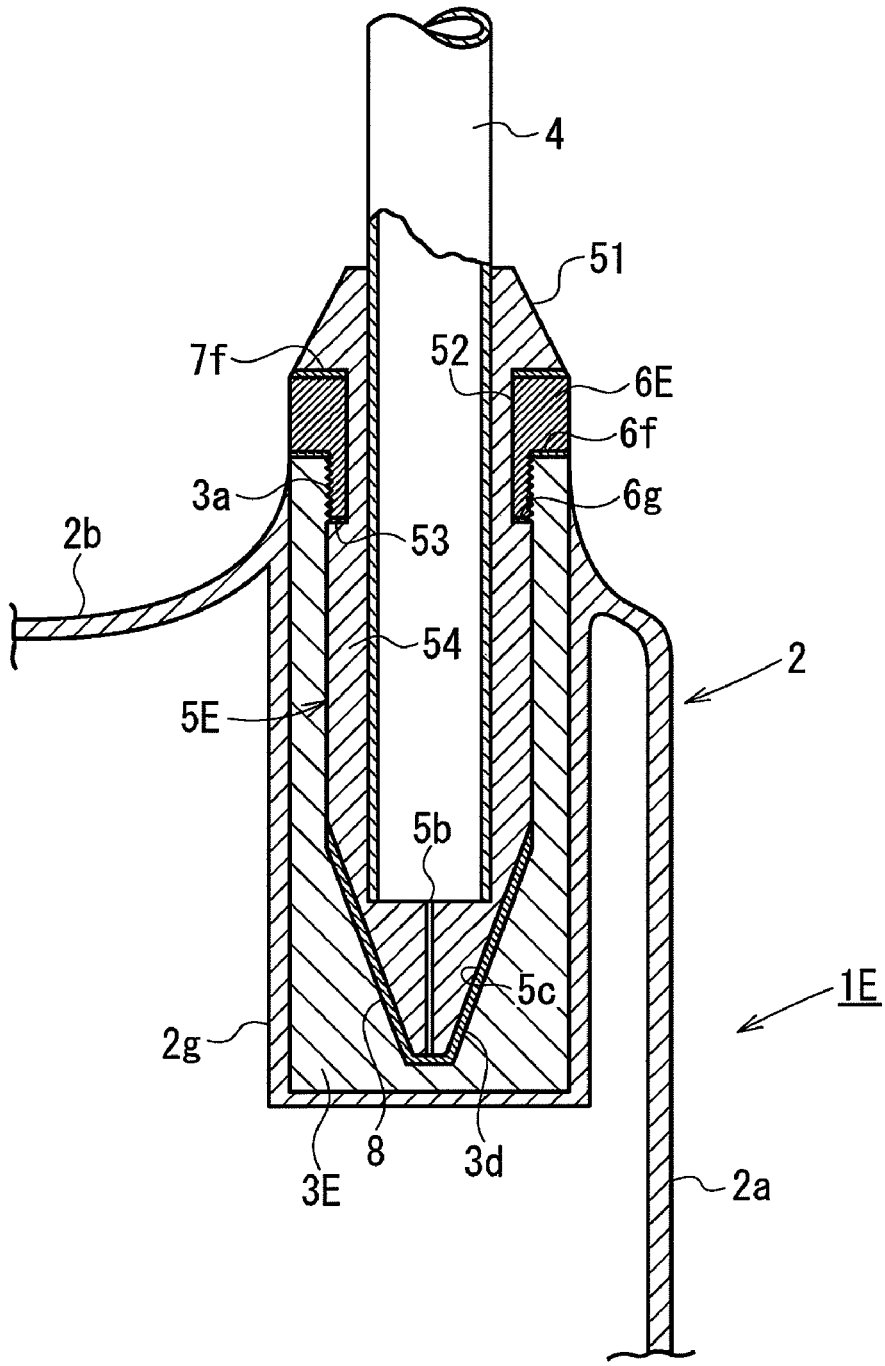
FIG. 21 is an exemplary section view of a head according to a seventh embodiment of the invention.
Figure 22:
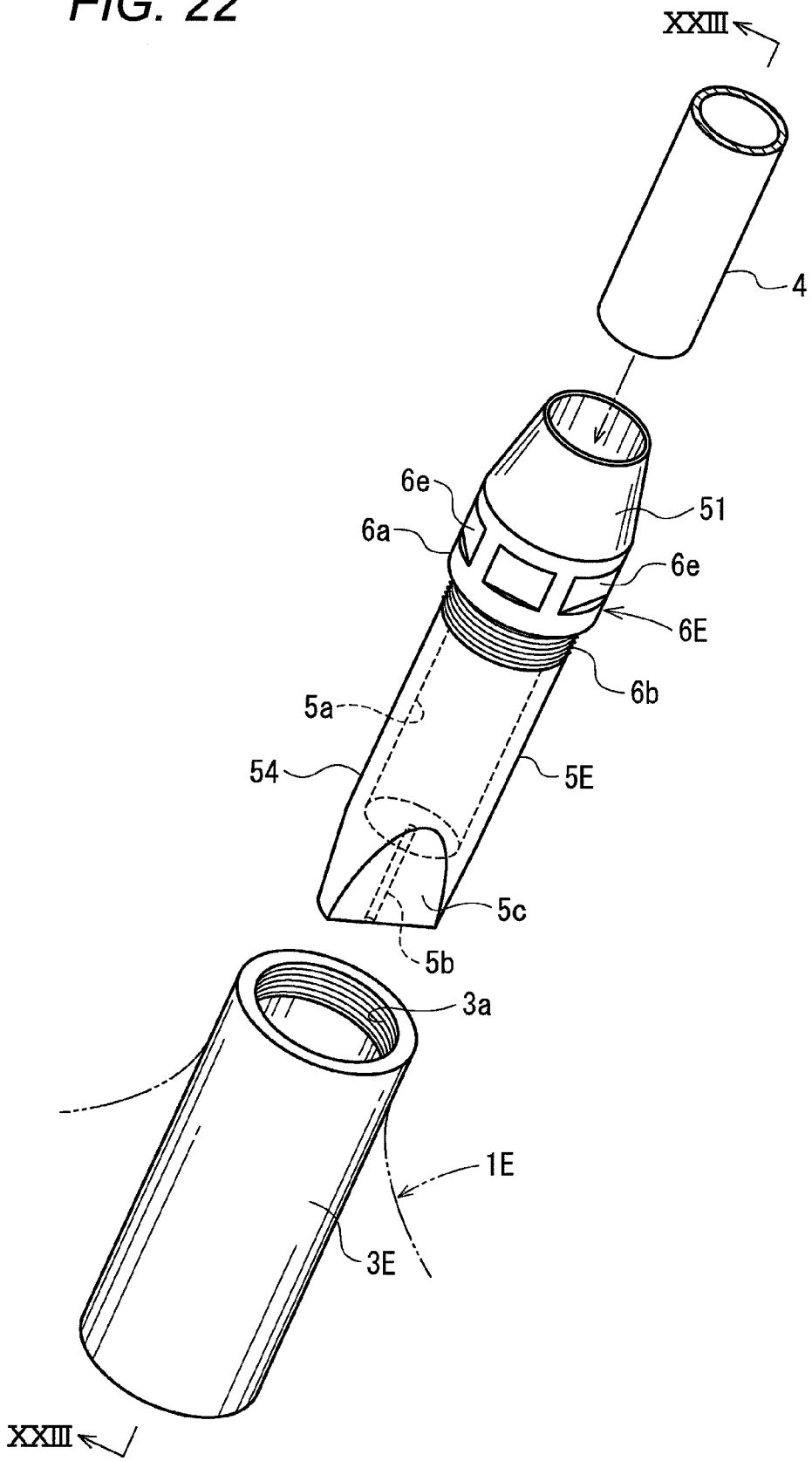
FIG. 22 is an exemplary exploded perspective view of the head shown in FIG. 21.
Figure 23:
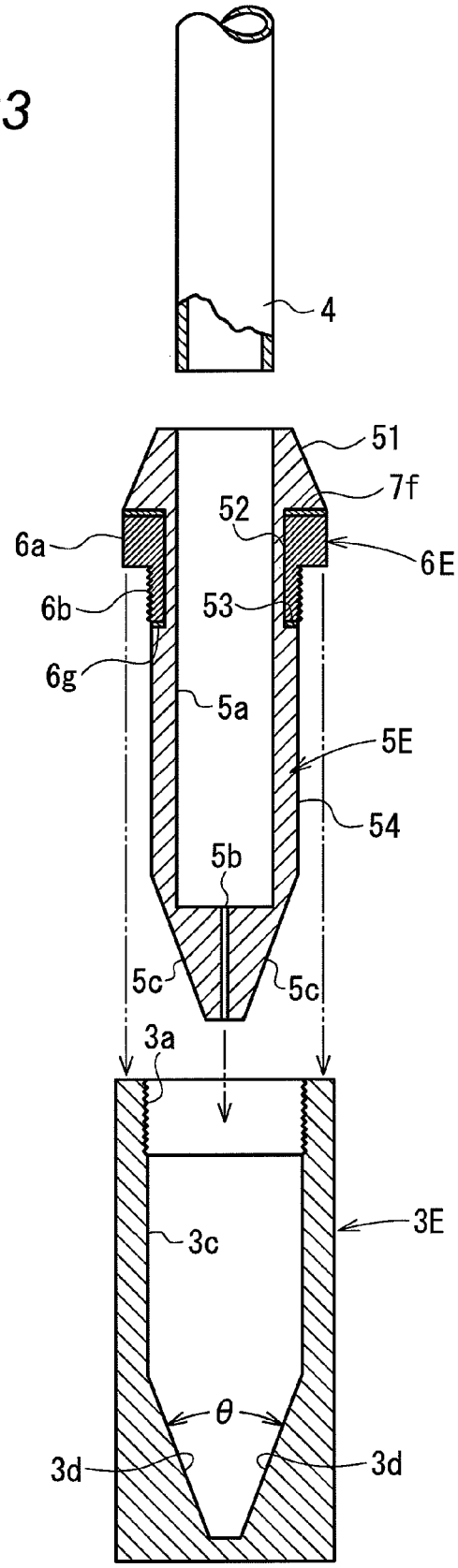
FIGS. 23 is an exemplary section view taken along the XXIII-XXIII line shown in FIG. 22.

According to the present embodiment, upwardly of the screw member 6, there is provided a top portion 7. This top portion 7 has a tapered ring-like shape the outer peripheral surface of which reduces in diameter as it goes upwardly. On the inner peripheral surface of the top portion 7, there is formed a female screw 7*a* which can be threadedly engaged with the male screw 5*n* of the shaft case 5. On the lower end side of the outer peripheral surface of the top portion 7, there are formed a pair of parallel surfaces 7*e*. Owing to this, a tool can be engaged with the parallel surfaces 7*e* to thereby rotate the top portion 7. Between the top portion 7 and screw member 6, there is formed a clearance which can be used to rotate the screw member 6; however, there may also be interposed between them a thin spacer 7*f* made of an elastic member such as rubber or an elastomer, or plastic, or metal. Here, the top portion 7 may also be fixed to the shaft case 5 by welding, by adhesion, by caulking or by similar proper means. Also, since the top portion 7 is used to allow the screw member 6 to rotate and also to prevent the screw member 6 from slipping off the shaft case 5, as shown in FIGS. 21 to 23 (which will be discussed later), the top portion 7 may also be formed integrally with a hosel case.

To assemble this golf club, as shown in FIG. 4, the top portion 7 and screw member 6 may be fitted with each other from the leading end side of the shaft 4, and the shaft case 5 may be previously fixed to the leading end of the shaft 4 using an adhesive. Preferably, the adhesive may be applied to the outer peripheral surface of the leading end portion of the shaft 4, and the shaft 4 may be inserted down to the deeper-most portion of the hole 5*a* of the shaft case 5.

Since the shaft case 5 includes the small hole 5*b*, when the shaft 4 is inserted into the hole 5*a* of the shaft case 5, the air is allowed to flow out through the small hole 5*b*. As the adhesive, there may preferably be used an epoxy-system adhesive.

The shaft case 5 of a shaft case/shaft connected assembly, in which the top portion 7 and screw member 6 are fitted with each other and the shaft case 5 is fixed in this manner, is inserted into the hosel 3 of the head 1 as shown in FIG. 4. Here, according to the present embodiment of the invention, thin-piece-shaped elastic members 8 respectively made of rubber, an elastomer or the like and having a small thickness (for example, a thickness of about 0.5 mm to 5 mm) have been previously applied onto the inclined surfaces 5*c*, 5*c* of the shaft case 5 and also onto the leading end face of the shaft case 5 by welding or by adhesion. The elastic members 8 may also have been provided on the shaft case 5 previously, or may also be provided after the shaft case/shaft connected assembly is formed.

As shown in FIGS. 5A and 5B, the shaft case 5 is inserted into the hosel 3; and, the inclines surfaces 5*c*, 5*c* and inclined surfaces 3*d*, 3*d* are superimposed on top of each other. Next, as shown in FIG. 5B, the male screw 6*b* of the screw member 6 is screwed into the male screw 3*a* of the hosel 3 and, after then, the top portion 7 is screwed into the male screw 5*a* of the shaft case 5.

As a result of this, as shown in FIG. 3, the lower end face of the screw member 6 is pressed against the upper surface of the projecting portion 5*t* of the shaft case 5, the inclined surfaces 5*c* of the shaft case 5 are pressed against the inclined surfaces 3*d* of the hosel 3 through the elastic members 8, and the shaft case 5 is fixed to the hosel 3. This completes a golf club in which the shaft 4 and head 1 are unified as an integral body, since the shaft case 5 and shaft 4 are firmly bonded to each other by the adhesive.

According to the present embodiment, the screw member 6 is fitted with the outer surface of the shaft case 5 and is screwed into the hosel 3, and the top portion 7 is screwed into the outer periphery of the upper end of the shaft case 5; and, when the screw member 6 and top portion 7 are rotated, they are prevented from touching the shaft 4. This can prevent the shaft 4 against damage.

To pull out the shaft case 5 from the golf club, in a state where the top portion 7 is fixed to the shaft case 5, the screw member 6 may be turned in the loosening direction thereof. Since the male screw 6*b* of the screw member 6 is in threaded engagement with the female screw of the hosel 3, when the screw member 6 is turned in the loosening direction, the screw member 6 is moved (threadedly moved) upwardly to thereby push up the top portion 7. Since the top portion 7 is fixed to the shaft case 5, when the top portion 7 is pushed upwardly by the screw member 6, the top portion 7 and shaft case 5 are moved upwardly as an integral body. This moves the shaft case 5 in the upward direction where it can be removed from the hosel 3, thereby being able to remove the shaft case 5 from the golf club easily.

In this golf club, since the shaft case 5 with the shaft 4 is inserted into and is fixed to the hosel 3 using the screw member 6, the mounting strength and rigidity of the shaft 4 and shaft case 5 are enhanced.

Also, after the screw member 6 is screwed into the female screw 3*a* of the hosel 3, the top portion 7 is screwed into the male screw 5*n* of the shaft case 5, thereby being able to prevent the screw member 6 from loosening. Specifically, according to the present embodiment, the female screw 3*a* and male screw 6*b* are respectively reverse screws as well as the loosening rotation direction of the screw member 6 provides the tightening rotation direction of the top portion 7, thereby being able to prevent the loosening of the screw member 6.

Here, as shown in FIG. 3, since there are interposed the thin-piece-shaped elastic members 8 made of rubber, an elastomer or the like between the inclined surfaces 3*d* of the hosel 3 and the inclined surfaces 5*c* of the shaft case 5, shocks and vibrations at the impact time can be absorbed.

To replace the shaft of the golf club, a shaft case of the same type as the shaft case 5 may have been previously fixed to a new shaft to be substituted. Here, the top portion 7 and screw member 6 may also have been mounted on this shaft previously.

The screw member 6 of the currently used golf club is removed, and the currently used or old shaft is removed from the head 1 together with the currently used top portion 7 and screw member 6. Next, a new shaft (a shaft case/shaft connected assembly), which includes a shaft case, a top portion and a screw member mounted thereon, is inserted into the head 1 and is then fixed to the head 1 using the screw member 6 and top portion 7.

In this manner, according to the present embodiment, the operation to mount and replace a shaft can be carried out very simply and quickly. Here, conventionally, to replace a shaft, the hosel portion of a currently used golf club is heated to destroy the structure of a hardened adhesive, and the currently used or old shaft is removed; and, after then, a new shaft is fixed using an adhesive. That is, it takes several hours to about one day to complete this replacing operation. On the other hand, according to the present embodiment, by previously having mounted a shaft case 5 on a new shaft using an adhesive, such shaft replacing operation can be finished several minutes or so. This can realize a using system in which shafts each with a shaft case connected thereto for various specifications have been previously prepared and different shafts are sequentially mounted on the same head main body for testing the hitting feelings of the respective shafts.

Here, according to the present embodiment, owing to provision of the inclined surfaces 3*d* and 5*c*, the inner surface of the hole deep side of the hosel 3 and the outer surface of the lower end side of the shaft case 5 are respectively formed in a non-circular section shape (that is, the section thereof perpendicular to the axial line thereof is non-circular), and these inclined surfaces 3*d* and 5*c* are engaged with each other.

This can reduce the generation of rickety motion in the shaft 4 and can prevent the shaft 4 from rotating around the axial direction thereof. That is, the fixture rigidity of the shaft 4 in the torque direction thereof is enhanced.

Also, there are provided the pair of inclined surfaces 5*c* and 5*c*, and the leading end side of the shaft case 5 is thereby formed in a tapered shape. This can facilitate the insertion of the shaft case 5 into the hosel 3.

Figure 9A:
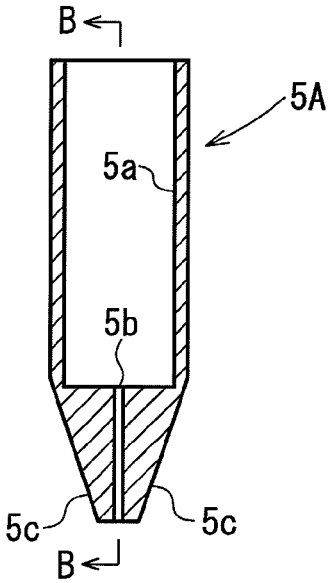
FIGS. 9A and 9B are exemplary section views of a shaft case according to a second embodiment of the invention.
Figure 9B:
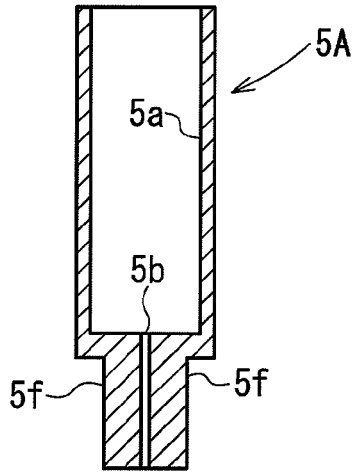

According to the invention, like a shaft case 5A shown in FIGS. 9A and 9B, there may also be provided a pair of parallel surfaces 5*f* on the leading end side of the shaft case. By gripping the parallel surfaces 5*f* using a gripping tool, the shaft case 5A can be easily mounted onto and removed from the shaft 4. The remaining structures of the shaft case 5A shown in FIGS. 9A and 9B are the same as the above-mentioned shaft case 5 and thus the same designations show the same composing portions respectively.

The hosel, shaft case and screw member may preferably be made of metal and, more preferably, they may be made of aluminum or titanium, or an aluminum alloy or a titanium alloy. The top portion 7 may preferably be made of aluminum or synthetic resin. The hosel 3, which is formed separately from the head 1, may preferably be made of material having an equal or lower specific gravity than the head main body; for example, as this material, there may be used a titanium alloy, aluminum, an aluminum alloy, a magnesium alloy, FRP, or synthetic resin.

The material of the head is not limited to a specific one but, in the case of a wood type golf club head, it may be made of, for example, a titanium alloy, an aluminum alloy, or stainless steel.

According to the present embodiment, although there are provided a pair of inclined surfaces 5*c*, 5*c* and a pair of inclined surfaces 3*d*, 3*d*, the number of inclined surfaces may also be one, or three or more. However, as shown in the drawings, it may preferably be a pair.

Here, as a grip to be mounted on the shaft 4, there can be used a grip the section of which is non-circular. For example, there is available a grip structured such that the lower side surface of the outer peripheral surface thereof, which faces the ground when a golfer addresses a ball, is expanded out from the remaining surfaces thereof. In this case, to mount the shaft case 5 onto the shaft 4, when the direction of the peripheral direction of the shaft case 5 is previously set so as to correspond to the grip expansion portion, the shaft can be mounted onto the head in such a manner that the grip expansion portion faces the ground positively.

Figure 10:
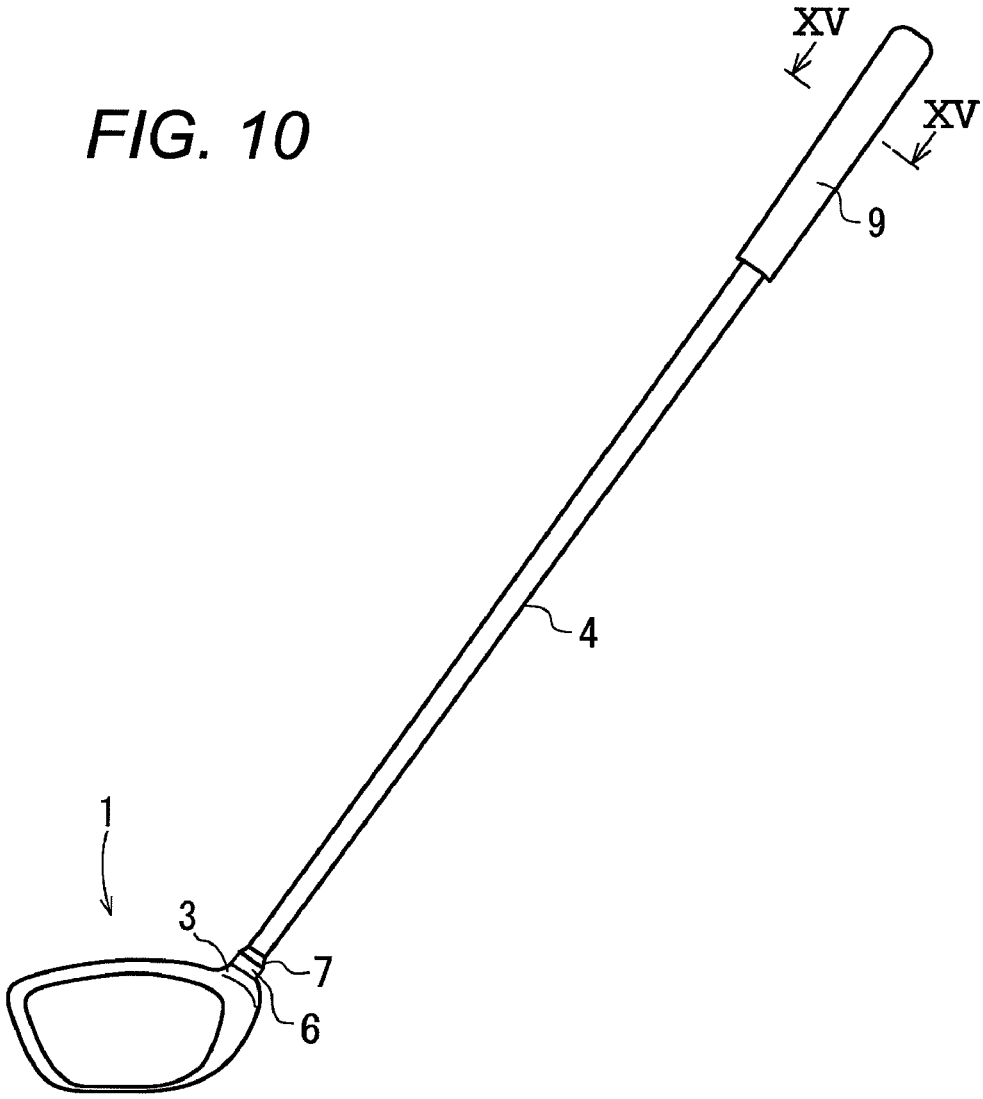
FIG. 10 is an exemplary front view of a golf club according to the second embodiment of the invention.

FIGS. 11 to 15 respectively show an example of such grip having a non-circular section, and FIG. 10 shows a golf club with such grip mounted on the club head 1.

Figure 11:
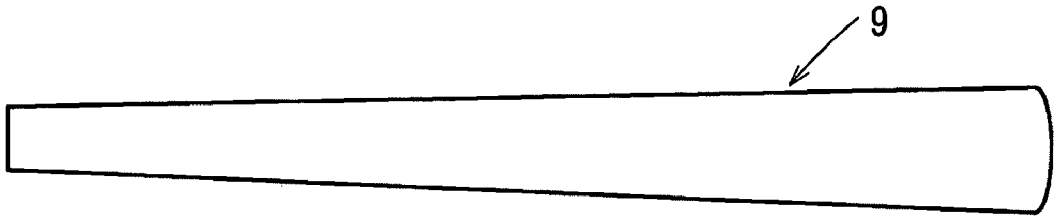
FIG. 11 is a section view of a grip shown in FIG. 10.
Figure 12:
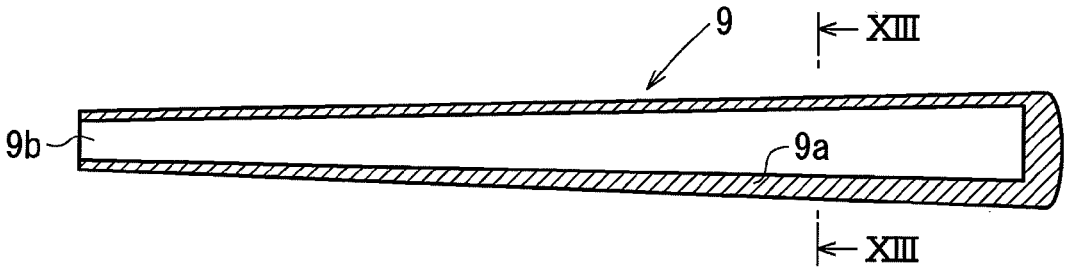
FIG. 12 is an exemplary section view of the grip.
Figure 13:
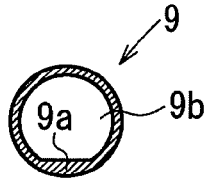
FIG. 13 is a section view taken along the XIII-XIII line shown in FIG. 12.
Figure 14:
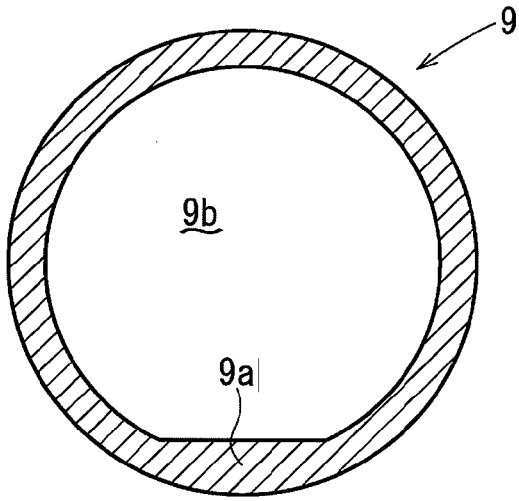
FIG. 14 is an enlarged view of FIG. 13.
Figure 15:
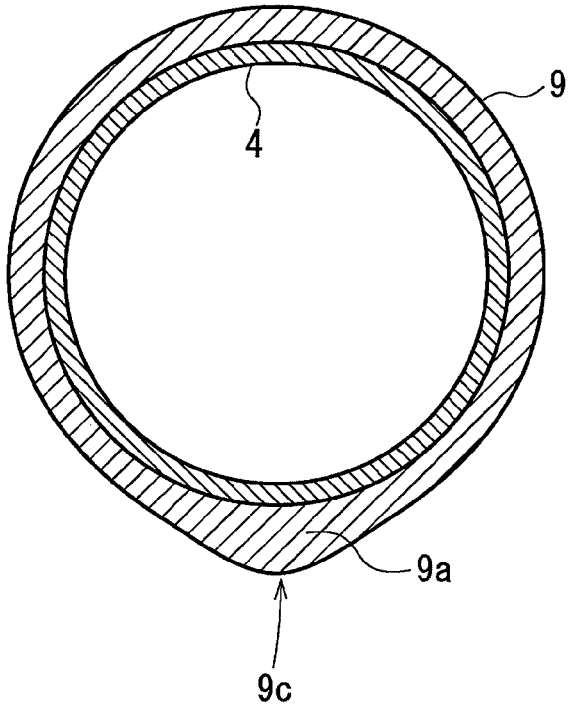
FIG. 15 is an enlarged section view taken along the XV-XV line shown in FIG. 10.

Here, FIG. 11 is a side view of a grip 9, FIG. 12 is a vertical section view of the grip 9 in the longitudinal direction thereof, FIG. 13 is a section view taken along the XIII-XIII line shown in FIG. 12, FIG. 14 is an enlarged view of FIG. 13, and FIG. 15 is an enlarged section view taken along the XV-XV line shown in FIG. 10, respectively.

As shown in FIG. 10, the leading end of the shaft 4 is inserted into the hosel of the head 1 and is fixed thereto using an adhesive. Here, preferably, the upper end side of the screw member 6 may have a conical shape like a ferrule as shown in FIG. 10, because this shape can be eliminate a strange feeling from the appearance of the screw member 6.

The grip 9 has a substantially cylindrical shape which includes an insertion hole 9*b* for insertion of the shaft 4, while the grip 9 is made of rubber or the like. A portion (in FIGS. 12, 13, 14 and 15, the lower side) of the grip 9 existing in the peripheral direction thereof is formed as a thick portion 9*a*. This thick portion 9*a* extends in the longitudinal direction of the grip 9. The thick portion 9*a* is formed such that the section shape of the inner peripheral surface of the grip 9 (that is, the section shape thereof in a direction perpendicular to the longitudinal direction of the grip 9) can provide a string-like shape. When the shaft 4 is inserted into this grip 9, as shown in FIG. 15, the thick portion 9*a* is pushed outwardly from inside and the outer periphery thereof is expanded to thereby form a projecting portion 9*c*. This projecting portion 9*c* extends in the longitudinal direction of the grip 9 (in the longitudinal direction of the shaft 4). The shaft cases 5, 5A may have been previously mounted on the shafts 4 in such a manner that the projecting portion 9*c* faces downward, that is, faces the ground when a golfer holds the golf club for addressing a ball, whereby there have been previously structured shaft case/shaft connected assemblies. In this case, even when any one of the shaft case/shaft connected assemblies is mounted on the head 1, the projecting portion 9*c* is always disposed correctly on the ground side in the golfer's address position.

Although there is used a golf club head of a wood type in the above-mentioned embodiment, the invention can also be applied to golf club heads of other types such as a utility type, an iron type and a patter.

Here, in the case of the golf club head of the illustrated hollow type, since the hosel 3, hosel installation portion 2*g*, shaft case 5 and screw member 6 are provided, the weight of the heel side of the head is large when compared with an ordinary gold club head. In view of this, preferably, the thickness of the toe side or back portion of the head may be increased or a weight may be provided on the toe side of the head to thereby keep its weight balance.

Figure 16:
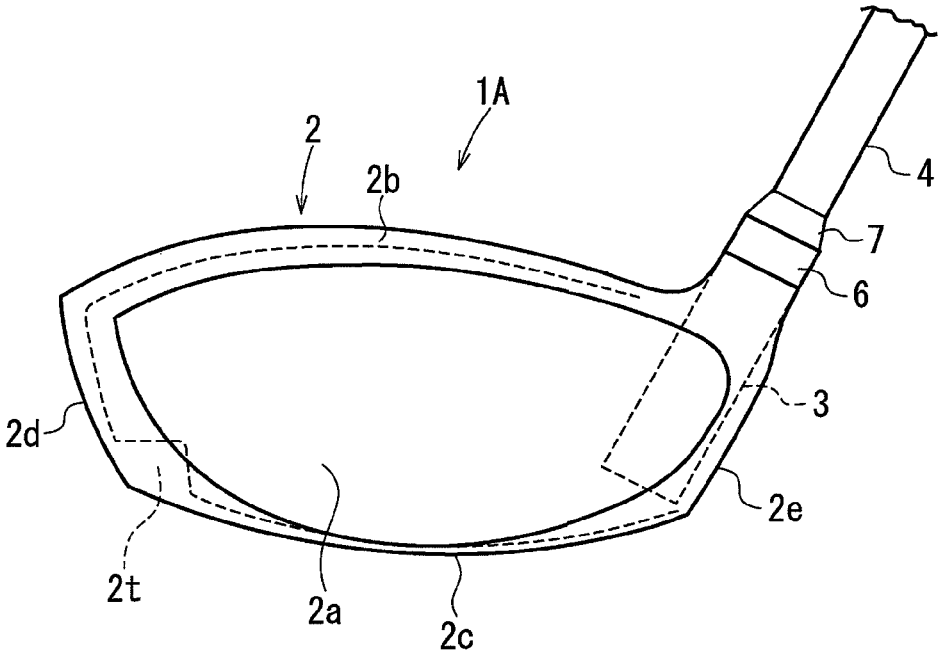
FIG. 16 is an exemplary front view of a head according to a third embodiment of the invention.
Figure 17:
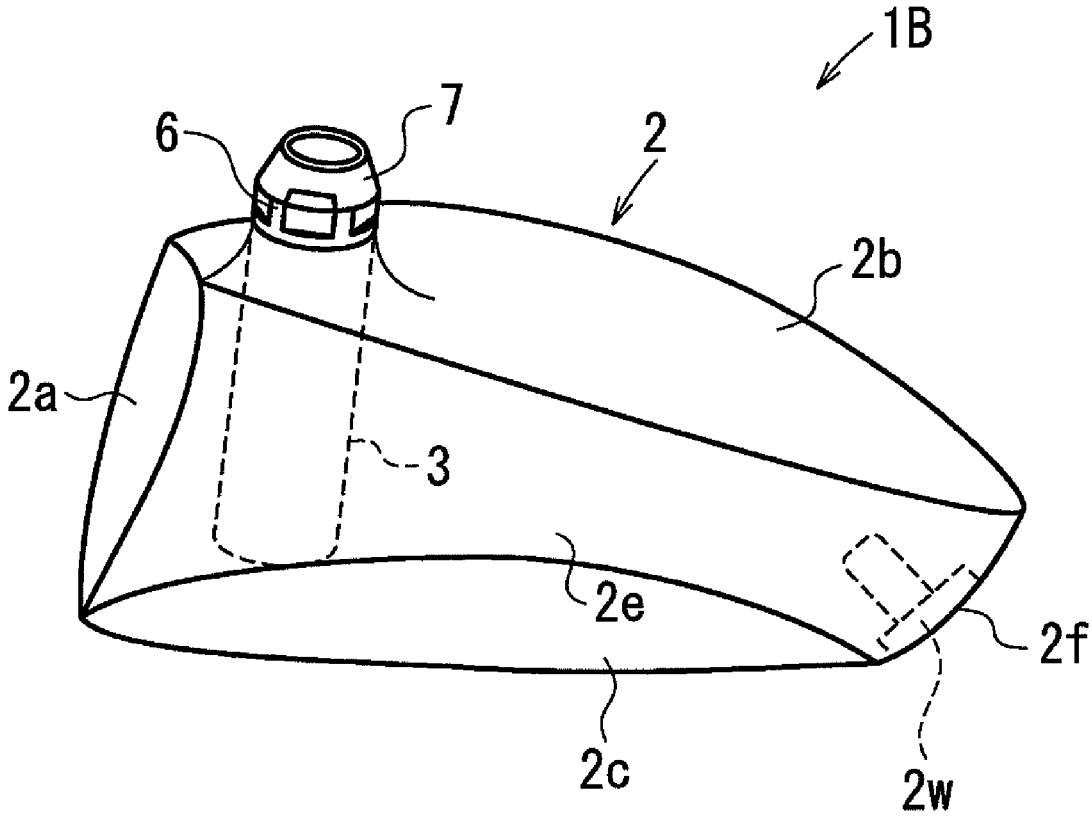
FIG. 17 is an exemplary side view of a head according to a fourth embodiment of the invention.

FIGS. 16 and 17 respectively show an example of such golf club head. Specifically, FIG. 16 is a front view of a golf club head 1A including a thick portion 2*t* formed on the toe portion 2*d* side of a head main body 2 thereof, and FIG. 17 is a side view of a golf club head 1B having a weight screw 2*w* mounted on the back portion 2*f* of a head main body 2 thereof. Here, in the sole portion, toe-side side portion or back portion of the golf club head, there may be formed a female screw hole for weight adjustment, and also there may be prepared a plurality of screws which are different in weight from each other. In this case, by replacing one screw with another differing in weight, the position of the center of gravity of the golf club head can be adjusted.

Specifically, as shown in FIG. 16, the toe side of the head may be formed thick or a weight member having a larger specific gravity than the head main body may be disposed on the toe side of the head. Structurally, when compared with an ordinary golf club head, the heel side of the present golf club head tends to be heavy.

The remaining structures of the golf club heads shown in FIGS. 16 and 17 are similar to the golf club head shown in FIGS. 1 and 2, and the same designations respectively show the same composing elements.

According to the invention, like a head 1C shown in FIG. 18, a head main body 2C and a hosel 3C may also be formed as an integral body. The remaining structures of the head shown in FIG. 18 are similar to the head shown in FIG. 3, and the same designations respectively show the same composing elements.

Figure 19:
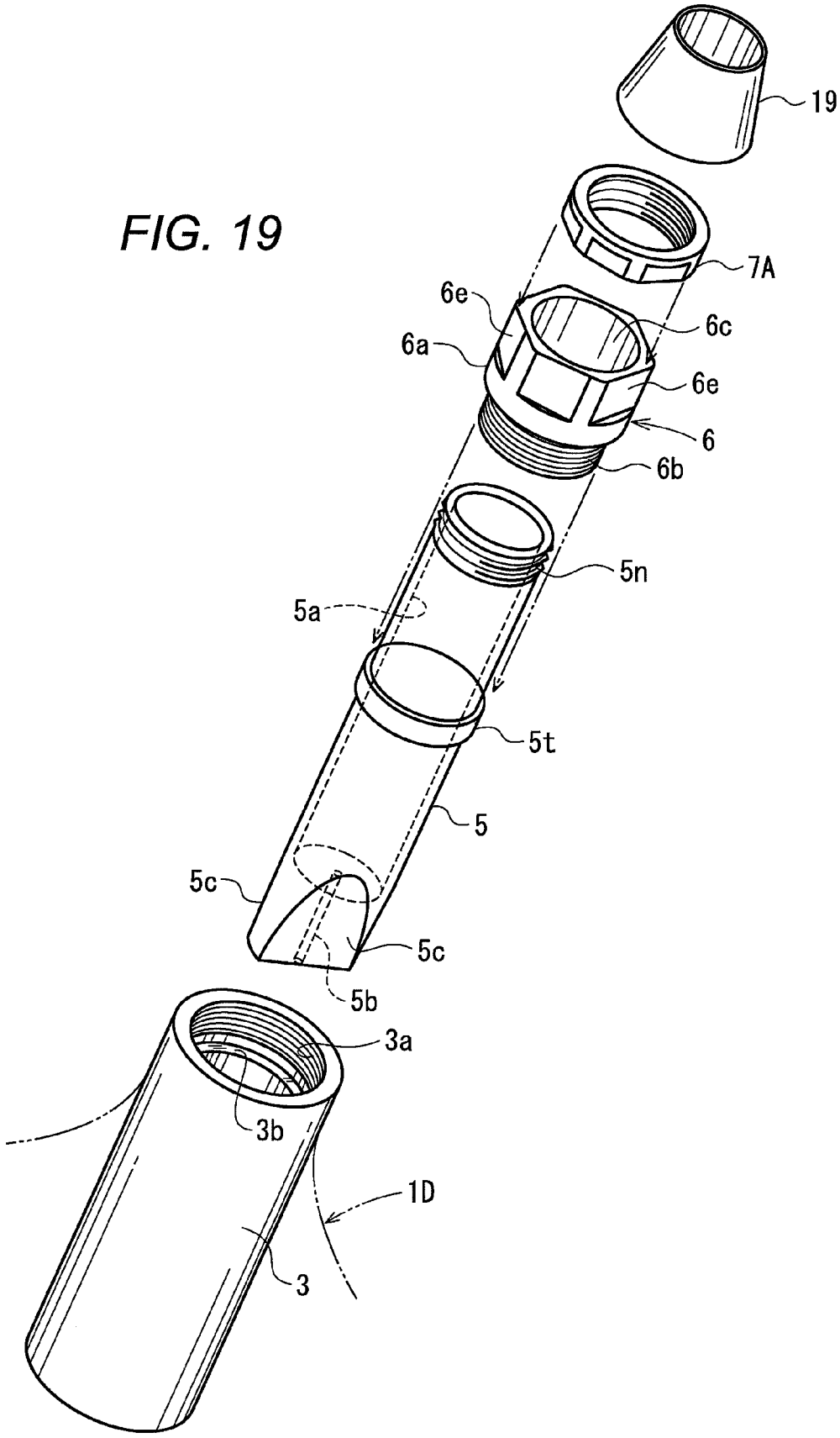
FIG. 19 is an exemplary perspective view of a hosel, a shaft case and a screw member according to a sixth embodiment of the invention.
Figure 20:
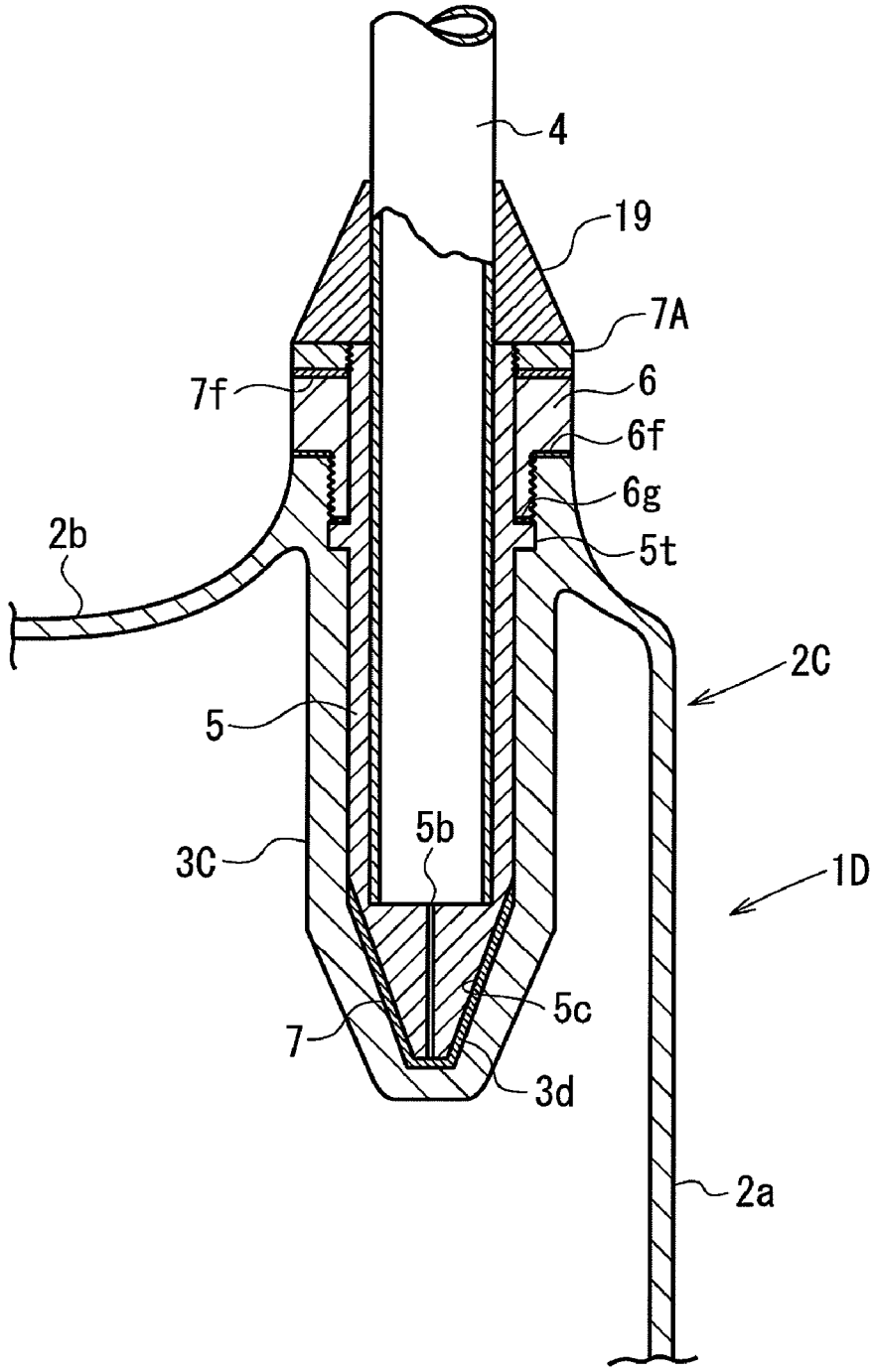
FIG. 20 is an exemplary section view of the head shown in FIG. 19.

According to the invention, like a head 1D shown in FIGS. 19 and 20, instead of the tapered top portion 7, a nut-shaped top portion 7A may also be threadedly engaged with the male screw 5*n* of the shaft case 5, and a ferrule 19 may be mounted on top of the top portion 7A. The remaining structures of the head shown in FIGS. 19 and 20 are similar to the head shown in FIG. 18, and the same designations respectively show the same composing elements.

According to the invention, there may also be employed a structure in which, instead of the nut-shaped top portion 7A, an enlarged-diameter portion is formed in the upper end of the shaft case. FIG. 21 is a section view of the heel side of a golf club head 1E having the above structure, FIG. 22 is a perspective view of a hosel 3E, a shaft case 5E and a screw member 6E used in the golf club head 1E, and FIG. 23 is a section view of the hosel 3E, shaft case 5E, and screw member 6E.

In the upper end of the shaft case 5E, there is formed integrally therewith an enlarged-diameter portion 51 having a tapered outer peripheral surface the diameter of which decreases as it goes upward. The lower surface of the enlarged-diameter portion 51, that is, the upper step surface thereof is superimposed on the upper surface of the screw member 6E through a spacer 7*f*. In the outer peripheral surface of the upper half section 6*a* of the screw member 6E, there is formed a flat end face 6*e* on which a tool such as a wrench or a monkey wrench can be put.

The lower portion of the enlarged-diameter portion 51 of the shaft case 5E is formed as a small diameter portion 52. The screw member 6E is rotatably fitted with the outer surface of the small diameter portion 52. The lower portion of the shaft case 5E than the small diameter portion 52 is formed as a large diameter portion 54 having a larger diameter than the small diameter portion 52. The lower end face of the screw member 6E is contacted through a spacer 6*g* with a step surface (lower step surface) 53 interposed between the small diameter portion 52 and large diameter portion 54. Similarly to the above-mentioned screw member 6, a male screw 6*b* is formed on the outer peripheral surface of the lower half section of the screw member 6E.

In the inner peripheral surface of the upper end side of the hosel 3E, there is cut formed a female screw 3*a*. In the present embodiment, the deeper portion of the hosel 3E than the female screw 3*a* is formed as cylindrical portion 3*c*. This cylindrical portion 3*c* has an inside diameter which allows the large diameter portion 54 to be fitted into the cylindrical portion 3*c*.

The remaining structures of the head according to the present embodiment are similar to the head shown in FIGS. 1 to 8, and the same designations respectively show the same composing elements.

To assemble this golf club, as shown in FIGS. 22 and 23, the leading end of the shaft 4 may have been inserted into the shaft case 5E and fixed thereto using an adhesive previously. Preferably, the adhesive may be applied onto the outer peripheral surface of the leading end portion of the shaft 4, and the shaft 4 may be then inserted down to the deeper-most portion of the hole 5*a* of the shaft case 5E.

The shaft case 5E of a shaft case/shaft connected assembly, which includes the screw member 6E and also to which the shaft case 5E is fixed in this manner, as shown in FIGS. 22 and 23, is inserted into the hosel 3E of the head 1, and the inclined surfaces 5*c*, 5*c* and inclined surfaces 3*d*, 3*d* are superimposed on top of each other. Next, the male screw 6*b* of the screw member 6E is screwed into the female screw 3*a* of the hosel 3E.

Accordingly, as shown in FIG. 21, the lower end face of the screw member 6E is pressed against the step surface 53 of the shaft case 5E, and the inclined surfaces 5*c* of the shaft case 5E are respectively pressed against their associated inclined surfaces 3*d* of the hosel 3 through the elastic members 8, whereby the shaft case 5E is fixed to the hosel 3E. Since the shaft case 5E and shaft 4 are firmly adhered to each other using the adhesive, there can be completed a golf club in which the shaft 4 and head 1E are unified as an integral body.

To pull out the shaft case 5E from this golf club, the screw member 6E may be turned in the loosening direction thereof. Since the male screw 6*b* of the screw member 6 is in threaded engagement with the female screw 3*a* of the hosel 3E, when the screw member 6E is turned in the loosening direction thereof, the screw member 6E is moved (threadedly moved) upwardly to push up the enlarged-diameter portion 51, whereby the shaft case 5E is moved upwardly. As a result of this, the shaft case 5E is moved in the upward direction where it moves apart from the hosel 3E, and thus the shaft case 5E can be removed easily.

Figure 24:
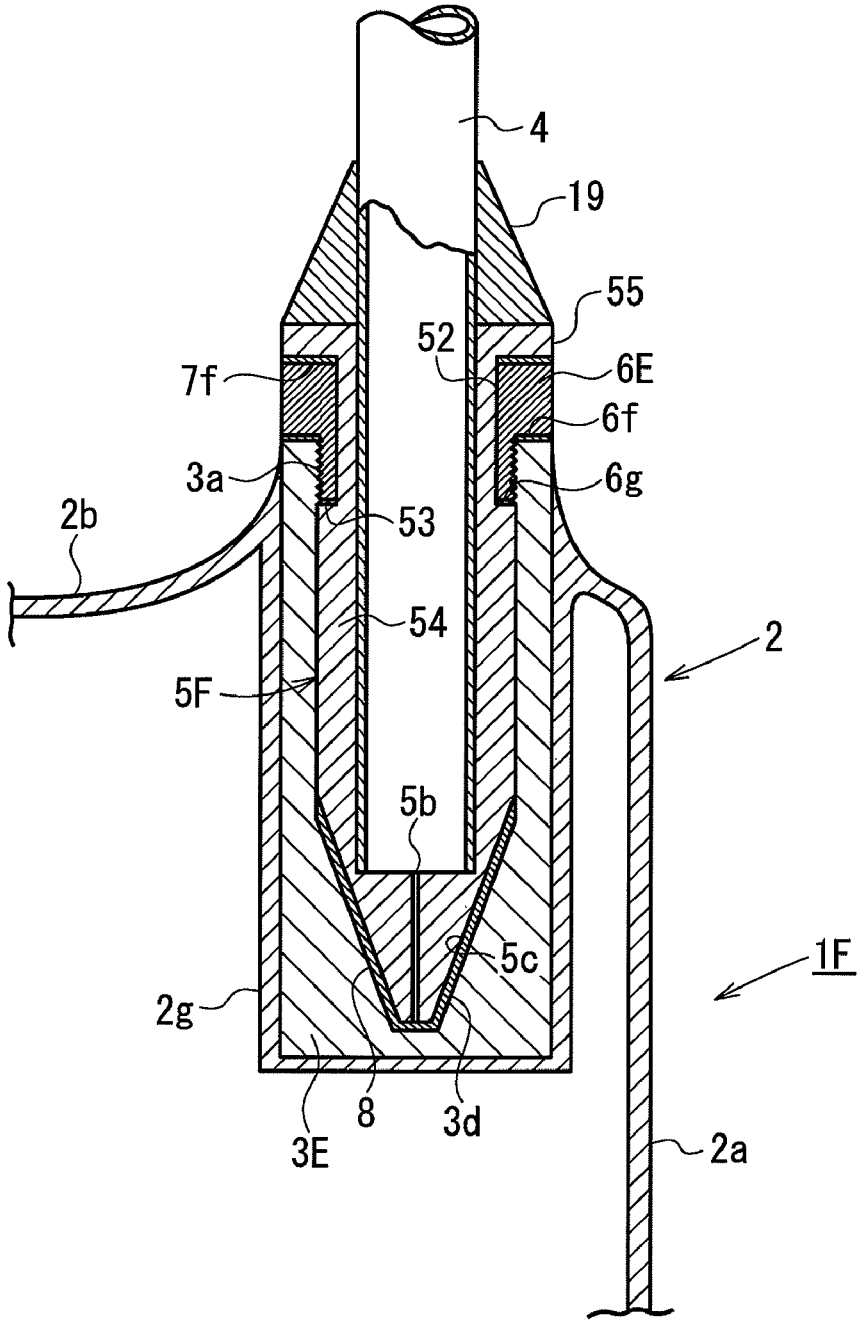
FIG. 24 is an exemplary section view of a head according to an eighth embodiment of the invention.
Figure 25:
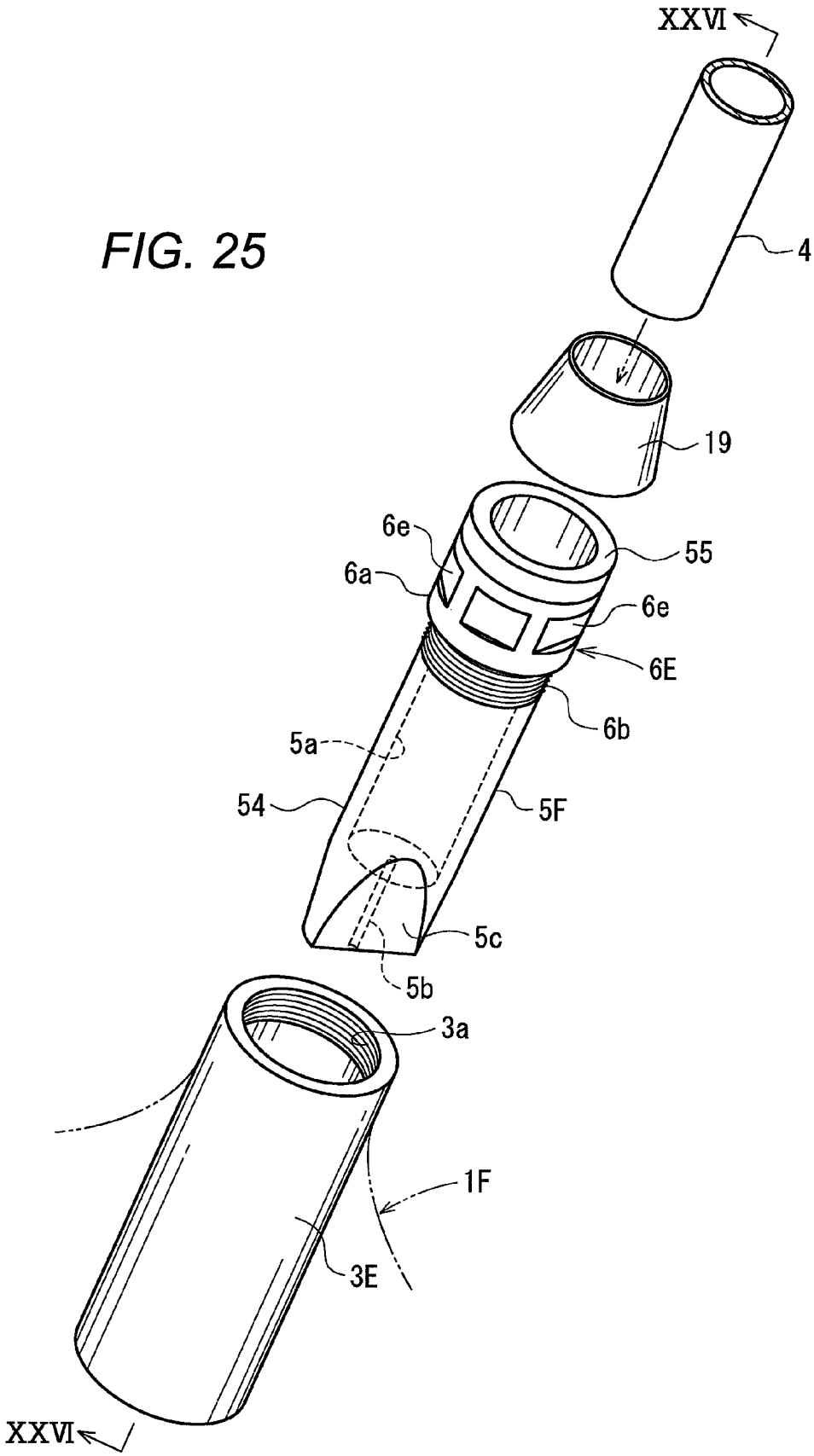
FIG. 25 is an exemplary exploded perspective view of the head shown in FIG. 24.
Figure 26:
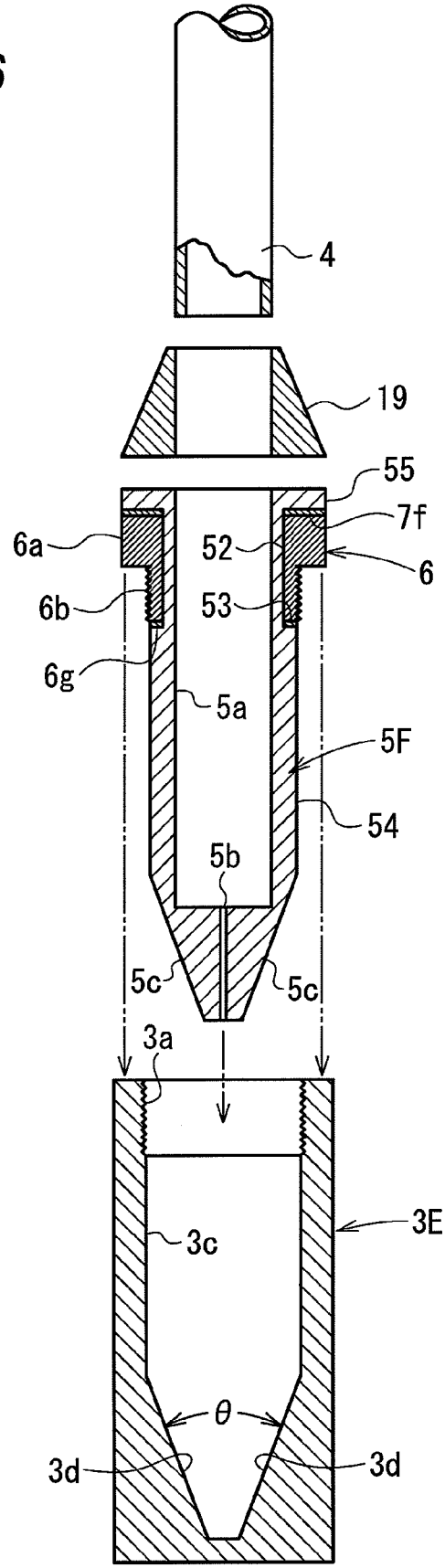
FIG. 26 is an exemplary section view taken along the XXVI-XXVI shown in FIG. 25.

In the present golf club, the enlarged-diameter portion 51 is formed to have a tapered shape. However, alternatively, like the shaft case 5F of a golf club 1F shown in FIGS. 24 to 26, there may also be formed an enlarged-diameter portion 55 having a flat flange shape, and a ferrule 19 may be mounted on top of the enlarged-diameter portion 55. The remaining structures of the golf club head shown in FIGS. 24 r 26 are similar to the golf club head shown in FIGS. 21 to 23 and the same designations respectively show the same composing elements.

What is claimed is:

1. A golf club comprising:

a head having a hosel;

a shaft;

a shaft case fixed to one end of the shaft, and configured to be inserted into the hosel, the shaft case being formed in a substantially cylindrical shape;

a ring-shaped screw member configured to be screwed into one end of the hosel to fix the shaft case in the hosel, and to be fitted with an outer face of the shaft case, the ring-shaped screw member being in noncontact with the shaft; and a threaded nut portion above the ring-shaped screw member that engages a threaded portion on the outer surface of the shaft case.

2. The golf club according to claim 1, wherein the shaft case includes a projecting portion on the outer face of a middle portion between the one end of the shaft case and the other end of the shaft case, wherein the head includes a head main body and the hosel fixed to the head main body, wherein one end of the hosel includes a female screw on an inner face of the hosel, wherein the ring-shaped screw member includes a male screw on an outer face thereof, the male screw being configured to be screwed on the female screw to fix the ring-shaped screw member to the hosel, and wherein the shaft case is configured to be fixed to the hosel by the ring-shaped member in a state that the ring-shaped screw member contacts with the projecting portion.

3. The golf club according to claim 2, wherein an elastic member is provided on a lower side of the screw member.

4. The golf club according to claim 2, wherein the shaft case is made of a cylindrical member having an open end on the one end of the shaft case and a close end on the other end of the shaft case, wherein the shaft is inserted into the shaft case and is fixed to the shaft case by using an adhesive.

5. The golf club according to claim 4, wherein the other end of the shaft case includes a non-circular shaped portion, and wherein an inner portion of the hosel includes a non-circular shaped portion corresponding to the other end of the shaft case.

6. The golf club according to claim 5, wherein the non-circular shaped portion of the shaft case includes an inclined surface obliquely intersecting with the center axis of the shaft case, and wherein the non-circular shaped portion of the hosel includes an inclined surface obliquely intersecting with the center axis of the hosel.

7. The golf club according to claim 1, further comprising an elastic member interposed between the other end of the shaft case and the other end of the hosel.

8. The golf club according to claim 1, further comprising a grip mounted on the other end of the shaft, the grip including a projecting portion extending in the longitudinal direction of the shaft.

9. The golf club according to claim 1, wherein the threaded nut portion is configured to abut an upper surface of the ring-shaped screw member via a spacer.

10. The golf club according to claim 1, wherein hosel comprises inclined surfaces that are arranged symmetrically with an axis of the hosel between them.

11. The golf club according to claim 10, wherein the angle between the inclined surfaces ranges from 10 to 30 degrees.

12. The golf club according to claim 10, wherein the inclined surfaces form a V-shaped configuration.

* * * * *